US010170125B2

(12) United States Patent
Villemoes et al.

(10) Patent No.: US 10,170,125 B2
(45) Date of Patent: Jan. 1, 2019

(54) AUDIO DECODING SYSTEM AND AUDIO ENCODING SYSTEM

(71) Applicant: DOLBY INTERNATIONAL AB, Amsterdam Zuidoost (NL)

(72) Inventors: Lars Villemoes, Järfälla (SE); Leif Jonas Samuelsson, Sundbyberg (SE); Kristofer Kjoerling, Solna (SE); Heiko Purnhagen, Sundbyberg (SE); Leif Sehlstrom, Järfälla (SE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/915,579

(22) PCT Filed: Sep. 8, 2014

(86) PCT No.: PCT/EP2014/069041

§ 371 (c)(1),
(2) Date: Feb. 29, 2016

(87) PCT Pub. No.: WO2015/036350

PCT Pub. Date: Mar. 19, 2015

(65) Prior Publication Data

US 2016/0232900 A1 Aug. 11, 2016

Related U.S. Application Data

(60) Provisional application No. 61/877,176, filed on Sep. 12, 2013.

(51) Int. Cl.
*G10L 19/008* (2013.01)

(52) U.S. Cl.
CPC ..... *G10L 19/008* (2013.01)

(58) Field of Classification Search
CPC ..... G10L 19/008; G10L 19/20; G10L 19/02; G10L 19/22; G10L 19/0204;
(Continued)

(56) References Cited

U.S. PATENT DOCUMENTS 6,449,371 B1 * 9/2002 Tan ..... H04S 3/02 381/119
7,107,211 B2 9/2006 Griesinger
(Continued)

FOREIGN PATENT DOCUMENTS

CN 1938760 3/2007
CN 1985303 6/2007
(Continued)

OTHER PUBLICATIONS

Bamford, P. et al "Separation of Multiple Signals in Hearing Aids by Output Decorrelation and Time-Delay Estimation" IEEE Workshop on Applications of Signal Processing to Audio and Acoustics, Oct. 15-18, 1995, pp. 7-10.

*Primary Examiner* — Yogeshkumar Patel

(57) ABSTRACT

An audio decoding system (100) for processing a two-channel input signal (X) comprises a parametric mixing stage (110). The parametric mixing stage receives the two-channel input signal and a set of mixing parameters (P1), and outputs a two-channel output signal (Y1). The parametric mixing stage comprises a decorrelation stage (111) outputting a decorrelated signal (D1) based on the input signal. The parametric mixing stage further comprises a mixing matrix (112) receiving the input signal and the de-correlated signal, and forming a two-channel linear combination of channels from the input signal and the decorrelated signal. The mixing matrix outputs the linear combination as the two-channel output signal. Coefficients of the linear combination are controllable by the set of mixing parameters, and at least four mixing parameters of the set are
(Continued)

independently assignable. In example embodiments, multiple parametric mixing stages are used to independently reconstruct additional channels encoded in the input signal.

23 Claims, 4 Drawing Sheets

(58) Field of Classification Search
CPC ..... G10L 19/167; G10L 19/24; G10L 25/18; H04S 2420/03; H04S 5/00; H04S 7/305; H04S 2420/11; H04S 7/302; H04R 5/00
USPC ..... 704/500; 381/22, 1, 300
See application file for complete search history.

(56) References Cited

U.S. PATENT DOCUMENTS 7,660,424 B2 2/2010 Davis
7,668,722 B2 * 2/2010 Villemoes ..... G10L 19/008 704/260
7,751,572 B2 7/2010 Villemoes
8,019,350 B2 9/2011 Purnhagen
8,170,882 B2 5/2012 Davis
8,194,861 B2 6/2012 Henn
8,223,976 B2 7/2012 Purnhagen
8,265,284 B2 9/2012 Breebaart
2003/0125933 A1 * 7/2003 Saunders ..... G09B 5/04 704/201
2006/0140412 A1 * 6/2006 Villemoes ..... G10L 19/008 381/12
2006/0165237 A1 * 7/2006 Villemoes ..... G10L 19/008 381/20
2008/0205658 A1 * 8/2008 Breebaart ..... H04S 3/004 381/17
2009/0125313 A1 * 5/2009 Hellmuth ..... G10L 19/008 704/501
2009/0240503 A1 * 9/2009 Miyasaka ..... G10L 19/008 704/500
2010/0296672 A1 * 11/2010 Vickers ..... H04H 60/04 381/119
2011/0013790 A1 1/2011 Hilpert
2011/0064229 A1 * 3/2011 Ehara ..... G10L 19/008 381/1
2011/0119061 A1 * 5/2011 Brown ..... G10L 19/008 704/258
2011/0255714 A1 * 10/2011 Neusinger ..... G10L 19/008 381/119
2012/0039477 A1 2/2012 Schijers
2012/0221343 A1 8/2012 Kim
2013/0173273 A1 * 7/2013 Kuntz ..... G10L 19/008 704/500
2013/0173274 A1 * 7/2013 Kuntz ..... G10L 19/008 704/500
2013/0317833 A1 * 11/2013 Davis ..... G10L 19/04 704/500
2014/0334724 A1 * 11/2014 Wu ..... H04N 19/91 382/166
2014/0355786 A1 * 12/2014 Betbeder ..... H03G 9/005 381/98
2016/0027446 A1 * 1/2016 Purnhagen ..... G10L 19/008 381/22
2016/0157039 A1 * 6/2016 Disch ..... G10L 19/008 381/22

FOREIGN PATENT DOCUMENTS

EP 1 410 687 1/2003
JP 2016-509260 3/2016
JP 2016-527804 9/2016
WO 2013/124446 8/2013
WO WO 2013/124446 * 8/2013

* cited by examiner

AUDIO DECODING SYSTEM AND AUDIO ENCODING SYSTEM

CROSS REFERENCE TO RELATED APPLICATIONS

This application claims priority to U.S. Provisional Patent Application No. 61/877,176, filed on 12 Sep. 2013, which is hereby incorporated by reference in its entirety.

TECHNICAL FIELD

The invention disclosed herein generally relates to multichannel audio coding and more precisely to techniques for parametric multichannel audio encoding and decoding.

BACKGROUND

Parametric stereo and multi-channel coding methods are known to be scalable and efficient in terms of listening quality, which makes them particularly attractive in low bitrate applications. Parametric coding methods typically offer excellent coding efficiency but may sometimes involve a large amount of computations or high structural complexity when implemented (intermediate buffers etc.). See EP 1 410 687 B1 for an example of such methods.

Existing stereo coding methods may be improved from the point of view of their bandwidth efficiency, computational efficiency and/or robustness. Robustness against defects in the downmix signal is particularly relevant in applications relying on a core coder that may temporarily distort the signal. In some prior art systems, however, an error in the downmix signal may propagate and multiply. A coding method intended for a large range of devices, in which multi-functional portable consumer devices may have the most limited processing power, should also be computationally lean so as not to demand an unreasonable share of the available resources in a given device, neither regarding momentary processing capacity nor total energy use over a battery discharge cycle. An attractive coding method may also enable at least one simple and efficient implementation in hardware. Making decisions on how such a coding method is to spend available computational, storage and bandwidth resources where they contribute most efficiently to the perceived listening quality is a non-trivial task, which may involve time-consuming listening tests. For example, when applying parametric coding methods, the selection of how to determine suitable parameter values and in which form to transmit and/or store these, may have significant impact the perceived listening quality.

BRIEF DESCRIPTION OF THE DRAWINGS

Example embodiments will now be described with reference to the accompanying drawings, on which.

All the figures are schematic and generally only show parts which are necessary in order to elucidate the disclosure, whereas other parts may be omitted or merely suggested. Unless otherwise indicated, like reference numerals refer to like parts in different figures.

DESCRIPTION OF EXAMPLE EMBODIMENTS

I. Overview

Figure 1:
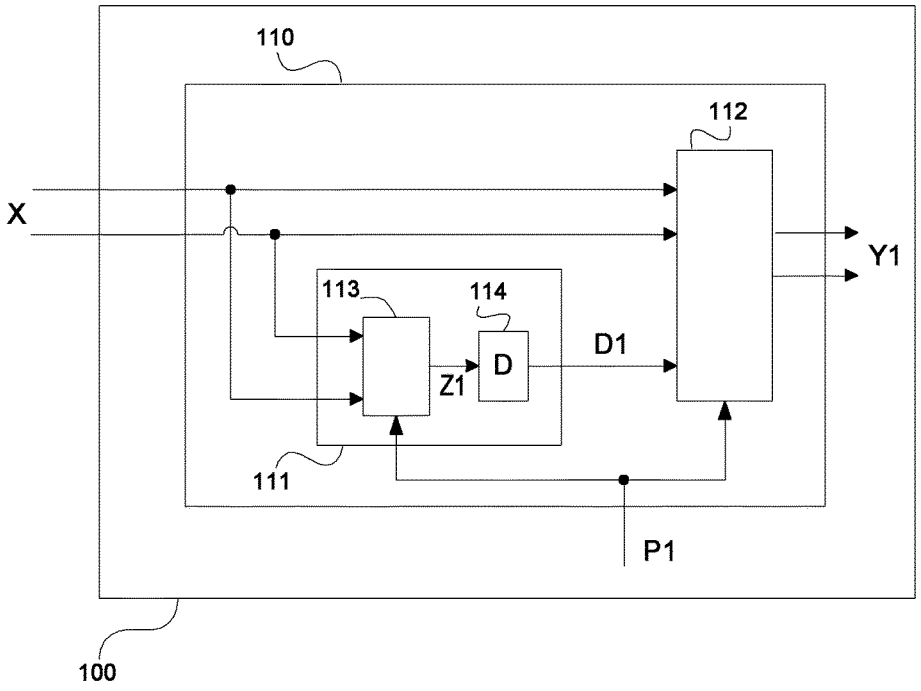
FIG. 1 is a generalized block diagram of an audio decoding system in accordance with a first example embodiment.

As used herein, an audio signal may be a pure audio signal, an audio part of an audiovisual signal or multimedia signal or any of these in combination with metadata.

According to a first aspect, example embodiments propose audio decoding systems, audio decoding methods and computer program products, for processing a two-channel input signal. The proposed audio decoding systems, audio decoding methods and computer program products may generally have the same or corresponding features and advantages.

According to example embodiments, an audio decoding system for processing a two-channel input signal is provided. The audio decoding system comprises a first parametric mixing stage adapted to receive the two-channel input signal and to receive a first set of mixing parameters. The first parametric mixing stage is further adapted to output a first two-channel output signal. The first parametric mixing stage comprises a first decorrelation stage adapted to output a first decorrelated signal based on the input signal. The first parametric mixing stage further comprises a first mixing matrix adapted to receive the input signal and the first decorrelated signal, to form a first two-channel linear combination of channels from the input signal and the first decorrelated signal, and to output the linear combination as the first two-channel output signal. Coefficients (i.e. at least some of the coefficients) of the first linear combination are controllable by the first set of mixing parameters, and at least four mixing parameters of the first set of mixing parameters are independently assignable.

By at least four mixing parameters of the first set of mixing parameters being independently assignable is meant that the received values of any one of these at least four mixing parameters may change while the received values for the rest of these at least four mixing parameters may remain unchanged. In particular, the first parametric mixing stage is configured to accept and execute—be it on different occasions—sets of parameter values differing by the value of one (arbitrary) mixing parameter only. The first two-channel linear combination is a two-channel signal formed by applying a plurality of coefficients to the channels of the input signal and the first decorrelated signal. By at least some of these coefficients being controllable by the first set of mixing parameters is meant that different values may be obtained for at least some of the coefficients by varying one or more of the mixing parameters, and that each of the at least four independently assignable mixing parameters contribute to the control of at least one of the coefficients (i.e. different parameters may contribute to the control of the same coefficient, or of different coefficients). That a mixing parameter contributes to the control of a coefficient may be taken to mean that the partial derivative of the coefficient, with respect to that mixing parameter, is nonzero, at least for some values of the mixing parameters (or almost everywhere in the parameter range/space).

An effect of receiving at least four independently assignable mixing parameters and using these to form the two-channel output signal based on the two-channel input signal, is that this allows more freedom at an encoder side encoding an original audio signal in the input audio signal. Indeed, the independently assignable mixing parameters may carry information about a coding and/or downmix operation carried out on an encoder side and may allow the decoding system to reconstruct channels of the original audio signal from the two-channel input signal, with a superior ability to adapt to the particular coding and/or downmix operation used on the encoder side.

Moreover, an original audio signal having more than two channels may have been encoded at an encoder side into the two-channel input signal of the decoding system, and the received at least four independently assignable mixing parameters may allow the decoding system to reconstruct, based on the input signal, any two of the channels of the original audio signal as the first two-channel output signal. Indeed, one set of values for the at least four independently assignable mixing parameters may govern/control reconstruction of a first pair of channels of the original audio signal, while another set of values for the at least four independently assignable mixing parameters may govern/control reconstruction, based on the same input signal, of a another pair of channels of the original audio signal in the same decoding system. For example, several functionally identical decoding systems (or mixing stages within the decoding system) may operate in parallel to reconstruct different channels of an original audio signal encoded in the input signal, the decoding systems (or mixing stages within the decoding system) being controlled by different sets of mixing parameters.

Since the decoding system receives as many as four independently assignable mixing parameters, the decoding system's reconstruction of an original audio signal may be less sensitive to deviations (e.g. transmission errors, inaccuracies or other unintended deviations) in the values of the received mixing parameters. This may allow use of a coarser and/or more bit-economical quantization of the received mixing parameters without detriment to the perceived quality of the reconstructed signal.

According to an example embodiment, the parameters of the first set of mixing parameters may be real-valued, i.e. the parameters may be real numbers.

According to an example embodiment, the first decorrelation stage may be adapted to output the first decorrelated signal as a one-channel signal. An effect of using a one-channel decorrelated signal is that only one decorrelator may be needed to provide the one-channel decorrelated signal, while the one-channel decorrelated signal provides sufficient controllability in the decoding system to obtain perceptually acceptable sound.

According to an example embodiment, the first decorrelation stage may comprise a premixing matrix and a decorrelator. The premixing matrix may be adapted to form an intermediate linear combination of channels from the input signal. In the present example embodiment, coefficients of the intermediate linear combination are controllable by the first set of mixing parameters only, i.e. no other parameter or variable received by the first decorrelation stage contributes to the control of the coefficients of the intermediate linear combination. The decorrelator may be adapted to receive the intermediate linear combination and to output, based thereon, the first decorrelated signal. For example, each of the coefficients of the intermediate linear combination may be controllable by the first set of mixing parameters.

One or more (e.g. two) of the at least four independently assignable mixing parameters may contribute to the control of at least some of the coefficients of the intermediate linear combination.

According to an example embodiment, the first set of mixing parameters comprises exactly four independently assignable mixing parameters. In other words, the first set of mixing parameters may comprise more than four mixing parameters, but exactly four of these mixing parameters are independently assignable in the present example embodiment. In particular, for the example embodiment described above, in which the first decorrelation stage comprises a premixing matrix, the first set of mixing parameters comprising exactly four independently assignable mixing parameters would imply that the four independently assignable mixing parameters, controlling coefficients in the first two-channel linear combination, also control the coefficients of the premixing matrix (without a contribution to the control of the coefficients from any additionally received parameters or variables).

According to an example embodiment, the decorrelator may comprise at least one infinite impulse response lattice filter adapted to receive a channel of the intermediate linear combination and to output a channel of the first decorrelated signal.

According to an example embodiment, the decorrelator may comprise an artifact attenuator configured to detect sound endings in the intermediate linear combination and to take corrective action in response thereto. In case the input signal goes silent after a period with active audio content, transients and/or other artifacts may be detectible by the human ear in the first output signal. By for example attenuating the intermediate audio signal at the beginning of such silent periods in the input signal, the decorrelator may reduce the impact of transients and/or other artifacts in the first decorrelated signal and in the first output signal.

According to an example embodiment, the audio decoding system may further comprise a second parametric mixing stage adapted to receive the two-channel input signal and to receive a second set of mixing parameters independent of the first set of mixing parameters. The second parametric mixing stage may be adapted to output a second two-channel output signal. The second parametric mixing stage may comprise a second decorrelation stage adapted to output a second decorrelated signal based on the input signal. The second parametric mixing stage may further comprise a second mixing matrix adapted to receive the input signal and the second decorrelated signal. The second mixing matrix may be adapted to form a second two-channel linear combination of channels from the input signal and the second decorrelated signal, and to output the second linear combination as the second two-channel output signal. At least some of the coefficients of the second linear combination may be controllable by the second set of mixing parameters, and at least four mixing parameters of the second set are independently assignable.

By the second set of mixing parameters being independent of the first set of mixing parameters is meant that the at least four independently assignable mixing parameters of the second set are independently assignable also relative to the mixing parameters in the first set. By at least some of the coefficients of the second two-channel linear combination being controllable by the second set of mixing parameters is meant that different values may be obtained for at least some of the coefficients by varying one or more of the mixing parameters of the second set, and that each of the at least four independently assignable mixing parameters of the second set contribute to the control of at least one of these coefficients (i.e. different parameters may contribute to the control of the same coefficient, or of different coefficients).

The first and second mixing stages may be run in parallel and independently of each other to produce the first and second two-channel output signals, respectively, based on the same input signal. The values of the first and second sets of mixing parameters, received by the first and second mixing stages, respectively, may cause the first and second mixing stages to produce distinct output signals even in an example embodiment in which the first and second mixing stages are functionally equivalent. The second mixing stage may be operable to receive the first set of parameters having properties such as quantization format, frequency band resolution and/or update frequency (i.e. how often new values can be assigned to the parameters) which differ from the corresponding properties of the first set of mixing parameters, received by the first mixing stage.

According to an example embodiment, the parameters of the second set of mixing parameters may be real-valued, i.e. the parameters may be real numbers.

According to an example embodiment, the first mixing matrix may be adapted to receive a first side signal comprising spectral data corresponding to frequencies up to a first crossover frequency. The first mixing matrix may be operable to form the first two-channel linear combination from the first side signal and channels from the input signal and the first decorrelated signal. In the present example embodiment, the second mixing matrix may be adapted to receive a second side signal comprising spectral data corresponding to frequencies up to a second crossover frequency (equal to or distinct from the first crossover frequency). The second mixing matrix may be operable to form the second two-channel linear combination from the second side signal and channels from the input signal and the second decorrelated signal.

A multichannel audio signal may be represented by the two-channel input signal, and channels of this multichannel audio signal may be reconstructed by the decoding system based on the two-channel input signal and the first and second sets of mixing parameters. The perceived sound quality of the reconstructed channels may be improved if parametric coding/decoding using the input signal and the mixing parameters is replaced (or complemented), for relatively lower frequencies to which the human ear is more sensitive, by discrete coding/decoding using the input signal and additional information from one or more side signals. For frequencies below the first crossover frequency, the first side signal may act as a side signal (or difference signal) for use together with one of the channels of the input signal acting as a mid signal (or sum signal). For frequencies below the first crossover frequency, the first mixing matrix may form the first two-channel linear combination from the first side signal and the channels of the input signal and the first decorrelated signal. For frequencies below the first crossover frequency, the first mixing matrix may for example provide the first linear combination by performing discrete decoding of a side/difference signal (the first side signal) and a mid/sum signal (a first channel of the input signal).Similarly, for frequencies below the second crossover frequency, the second mixing matrix may form the second two-channel linear combination from the second side signal and the channels of the input signal and the second decorrelated signal. For frequencies below the second crossover frequency, the second mixing matrix may for example provide the second linear combination by performing discrete decoding of a side/difference signal (the second side signal) and a mid/sum signal (the second channel of the input signal). For more details about the use of the first and second side signals, see the description below with reference to FIG. 4.

According to an example embodiment, the audio decoding system may further comprise a third parametric mixing stage adapted to receive the two-channel input signal and to receive a third set of mixing parameters independent of the first and second sets of mixing parameters. The third parametric mixing stage may be adapted to output a third output signal and the third parametric mixing stage may be adapted to provide at most one channel with independent audio content in the third output signal. The third parametric mixing stage may comprise a third mixing matrix adapted to receive the input signal, to form a third linear combination of channels from the input signal, and to output the third linear combination as the third output signal. At least some coefficients of the third linear combination may be controllable by the third set of mixing parameters and at least two mixing parameters of the third set are then independently assignable.

The third output signal may be a one-channel signal, or it may be a multichannel signal (e.g. a two-channel signal similarly to the first and second output signals), but in this example embodiment, the third output signal comprises at most one channel with independent audio content. For example, the third output signal comprises one channel with audio content and one or more empty/neutral audio channels without independent audio content.

In some example embodiments, the third mixing stage may be functionally similar to the first mixing stage in that the third mixing stage may comprise a third decorrelation stage outputting a third decorrelated signal based on the input signal, the third decorrelated signal being used by the third mixing matrix to form the third output signal.

According to an example embodiment, the parameters of the third set of mixing parameters may be real-valued, i.e. the parameters may be real numbers.

According to an example embodiment, the decoding system may comprise a third parametric mixing stage adapted to receive the two-channel input signal and to receive a third set of mixing parameters independent of the first and second sets of mixing parameters. The third parametric mixing stage may be adapted to output a third output signal. The third parametric mixing stage may comprise a third decorrelation stage adapted to output a third decorrelated signal based on the input signal. The third parametric mixing stage may comprise a third mixing matrix adapted to receive the input signal and the third decorrelated signal, to form a third two-channel linear combination of channels from the input signal and the third decorrelated signal, and to output the third linear combination as the third two-channel output signal. At least some coefficients of the third linear combination may be controllable by the third set of mixing parameters, and (unlike the previous example embodiment) at least four mixing parameters of the third set are then independently assignable.

By using three parametric mixing stages, the decoding system of the present example embodiment may provide up to six output channels with independent content, based on the two-channel input signal and the received mixing parameters.

According to an example embodiment, the audio decoding system may comprise a controller adapted to receive a collection of mixing parameters. The controller may be adapted to provide the first, second and third sets of mixing parameters, being subsets of the received collection of parameters, to the first, second and third parametric mixing stages, respectively. The controller may be adapted to control the third mixing stage, via the third set of mixing parameters, to provide at most one channel with independent audio content in the third output signal.

The first, second and third parametric mixing stages of the present embodiment may be functionally identical, but the third mixing stage may be controlled by the controller to provide a different type of output than that of the first and second parametric mixing stages. The third parametric mixing stage may for example be controlled to provide the third output signal as a one-channel audio signal accompanied by an empty (zero/neutral) channel. The controller may for example be a demultiplexer extracting the first, second and third sets of mixing parameters from a bitstream and providing the first, second and third sets of mixing parameters to the first, second and third mixing stages, respectively.

According to an example embodiment, the audio decoding system may further comprise an additional parametric mixing stage adapted to receive the two-channel input signal and an extended set of mixing parameters comprising at least three mixing parameters from the first set of mixing parameters, at least three parameters from the second set of mixing parameters and at least one additional mixing parameter independent of the first, second and third sets of mixing parameters. The additional parametric mixing stage may be adapted to output an additional output signal having at least five channels. The decoding system may further comprise a summing stage adapted to add channels of the additional output signal to channels of the first output signal, the second output signal and the third output signal, respectively. The additional parametric stage may comprise an additional decorrelation stage adapted to output an additional decorrelated signal based on the input signal. The additional parametric stage may comprise an upmix matrix adapted to generate the additional output signal based on the additional decorrelated signal and the extended set of mixing parameters.

Using the additional decorrelated signal to form additive contributions to the first, second and third output signals may improve an ability of the decoding system to provide a more faithful reconstruction of a multichannel audio signal represented by the input audio signal. The use of the additional decorrelated signal to form additive contributions to the first, second and third output signals may e.g. increase the perceived dimensionality of the playback sound during five-channel playback of the channels of the first, second and third output signals.

In some example embodiments, the mixing parameters from the extended set of parameters may include at least three of the independently assignable parameters from the first set of mixing parameters and at least three of the independently assignable parameters from the second set of mixing parameters, and each of these independently assignable mixing parameters included in the extended set of parameters may contribute, in the sense discussed previously, to the control of at least one coefficient used by the upmix matrix to form the additional output signal. The additional mixing parameter may also contribute to the control of at least one coefficient used by the upmix matrix to form the additional output signal.

According to an example embodiment, the first parametric mixing stage may be adapted to receive values of the first set of mixing parameters associated with a plurality of frequency subbands. The first parametric mixing stage may be adapted to operate on frequency subband representations of the input signal and the first decorrelated signal using values of the first set of mixing parameters associated with the corresponding frequency subbands (i.e. the values used are associated with the corresponding frequency subbands).

Similarly, in some example embodiments, the second, third and/or fourth parametric mixing stage (or the entire decoding system) may be adapted to operate on frequency subband representations of the input signal (and of the decorrelated signals) using values of the mixing parameters associated with the corresponding frequency subbands. In some example embodiments, different frequency subband partitions may be used in different parametric mixing stages of a decoding system.

According to an example embodiment, the first parametric mixing stage may be adapted to employ a non-uniform frequency subband partition. This may allow for computational efficiency and/or bandwidth reduction of transmitted parameters for frequency ranges in which the human ear is relatively less sensitive, by using a relatively coarser subband partition, and it may allow for improved fidelity of reconstructed audio signals for frequency ranges in which the human ear is relatively more sensitive, by using a relatively finer subband partition, at the cost of accuracy in less sensitive frequency ranges.

According to an example embodiment, at least one independently assignable parameter of the first set of mixing parameters may control a contribution of the first decorrelated signal to the first linear combination. According to an example embodiment, two independently assignable parameters of the first set of mixing parameters may be received by the first parametric mixing stage in a first quantized format and may control relative contributions of the two input signal channels to an intermediate linear combination. Further, two different independently assignable parameters of the first set of mixing parameters may be received by the first parametric mixing stage in a second quantized format, distinct from the first quantized format and may control relative contributions of the intermediate linear combination and the first decorrelated signal to the first output signal. In the present embodiment, the first decorrelated signal is a decorrelated version of the intermediate linear combination.

In the present embodiment, there are mixing parameters of different types, and/or having qualitatively different roles in the first parametric mixing stage The use of different quantization formats for different parameter types may improve coding efficiency since bandwidth and/or storage space may be saved by e.g. using a coarser quantization scale for parameters types for which small deviations may cause relatively less impact on the experienced audio quality of the output signals. The quantization formats may also be chosen to match measured or experienced statistics of the parameters.

In some example embodiments, at least some of the parametric mixing stages may be adapted to receive their respective sets of mixing parameters in different quantization formats, i.e. different parametric mixing stages in a decoding system may receive mixing parameters in different quantization formats.

According to an example embodiment, the first parametric mixing stage may be adapted to receive the input signal having a first time resolution in which it is divided into time frames comprising a constant number of samples, i.e. the time frames comprising the same number of samples. The first parametric mixing stage may be operable to receive, during a time frame, one value of each of the first set of mixing parameters. The first parametric mixing stage may be further operable to receive, during a time frame, two values of each of the first set of mixing parameters.

In other words, the first parametric mixing stage may receive one or two values of each of the first set of mixing parameters in a time frame, e.g. depending on availability of such values in the time frame, or in response to a dedicated signal indicating how many values to receive in the time frame. See also the description below with reference to FIGS. 2*a-d*.

The time frames may for example be MDCT frames Modified Discrete Cosine Transform). A typical MDCT frame length is 1536 samples.

According to an example embodiment, the first parametric mixing stage may be operable to receive the first set of mixing parameters having the first time resolution, and to employ interpolation over time to produce a set of one or more mixing parameters having a second time resolution from the first set of mixing parameters having the first time resolution. The second time resolution may for example be used by the first mixing stage when processing the input signal. For more details about interpolation, see the description below with reference to FIGS. 2*a-d*.

Interpolation of the mixing parameters may for example reduce noise, instability and/or other undesirable effects, in the first output signal, otherwise occurring when rapidly varying mixing parameters are used in the decoding system.

In some example embodiments, different interpolation techniques may be employed in different parametric mixing stages of a decoding system.

According to an example embodiment, the first and second parametric mixing stages may be functionally identical. For example, two identical parametric mixing stages may be used as the first and second parametric mixing stages. Although functionally identical, the first and second parametric mixing stages may be controlled by the first and second sets of mixing parameters to produce distinct first and second output signals.

According to some example embodiments, the second and/or third decorrelation stage may have the same structure as the first decorrelation stage, i.e. it may comprise a premixing matrix and a decorrelator with the same responsibilities as in the first mixing stage.

According to some example embodiments, the second, third and/or fourth decorrelated signals may be obtained using one or more decorrelators of the same type as the decorrelator used in the first mixing stage to obtain the first decorrelated signal. In some example embodiments, different settings may be used in the decorrelators of the different parametric mixing stages.

According to a second aspect, example embodiments propose audio encoding systems, audio encoding methods and computer program products for processing a multichannel input signal. The proposed encoding systems, encoding methods and computer program products may generally have the same or corresponding features and advantages.

Advantages regarding features and setups as presented above for a decoding system according to the first aspect may generally be valid for the corresponding features and setups for an encoding system according to the second aspect, adapted to cooperate with the decoding system.

According to example embodiments, an audio encoding system for processing a multichannel input signal is provided. The audio encoding system comprises a mixing stage adapted to receive the multichannel input signal and to output, based thereon, a two-channel output signal. The encoding system further comprises a parameter analyzer adapted to receive the multichannel input signal and the two-channel output signal. The parameter analyzer comprises a first parameter analyzing stage adapted to output, based on the two-channel output signal and on two channels of the multichannel input signal, a first set of mixing parameters for controlling a first parametric mixing stage for reconstructing the two channels of the multichannel input signal from the two-channel output signal. The first parameter analyzer further comprises a second parameter analyzing stage adapted to output, based on the two-channel output signal and on at least one channel of the multichannel input signal (distinct from each of the two channels of the multichannel input signal used by the first parameter analyzing stage), a second set of mixing parameters for controlling a second parametric mixing stage for reconstructing the at least one channel of the multichannel input signal from the two-channel output signal. In the encoding system of the present example embodiment, the second parameter analyzing stage is configured to operate independently of the first parameter analyzing stage, i.e. the second parameter analyzing stage is configured to determine the second set of mixing parameters without relying on data/information received from the first parameter analyzing stage.

The two-channel output signal may be suitable for storage and/or transmission together with the mixing parameters, as an alternative to handling the full multichannel signal.

The second set of parameters being determined by the second parameter analyzing stage, independently from the first parameter analyzing stage, allows for increased freedom in selecting techniques/methods for determining the parameters of the second set, independently of the techniques/methods used for determining the parameters of the first set. Moreover, properties of the parameters, such as quantization formats, frequency band resolution and update frequency (i.e. how often new values can be assigned to the parameters) may be different for the first and second sets of mixing parameters.

The freedom in selecting techniques/methods and/or parameter properties may allow for a more bit-efficient use of the mixing parameters and/or may allow for increasing the perceived sound quality of channels of the multichannel input signal reconstructed based on the two-channel output signal and the mixing parameters.

For example, the first parameter analyzing stage may employ techniques/methods and/or parameter properties which are particularly suited for reconstruction of the two channels of the multichannel input signal from the two-channel output signal, while the second parameter analyzing stage may employ techniques/methods and/or parameter properties particularly suited for reconstructing the at least one channel of the multichannel input signal from the two-channel output signal. In particular, the techniques/methods and/or parameter properties employed by the first parameter analyzing stage may be adapted (i.e. adjusted as time passes) based on the audio content of the received two channels of the multichannel input signal and the two-channel output signal, and/or the techniques/methods and/or parameter properties employed by the second parameter analyzing stage may be adapted (i.e. adjusted as time passes) based on the audio content of the received at least one channel of the multichannel input signal and the two-channel output signal. The respective techniques/methods may as well be selected on the basis of known or expected properties of the channels in the multichannel input signal. For instance, it may be reasonable to expect different statistical properties in front channels than in surround channels.

In some example embodiments, the first parameter analyzing stage may be configured to operate independently of the second parameter analyzing stage, i.e. it may be configured to determine the first set of mixing parameters without relying on data/information received from the second parameter analyzing stage. In particular, the first parameter analyzing stage and/or the second parameter analyzing stage may be configured to accept a self-contained stream of input data without relying on intermediate results produced by a different parameter analyzing stage.

In some example embodiments, the first set of mixing parameters may be adapted for controlling at least one two-channel linear combination to be performed in a first parametric mixing stage for reconstructing the two channels of the multichannel input signal from the two-channel output signal. Similarly, the second set of mixing parameters may be adapted for controlling at least one two-channel linear combination to be performed in a second parametric mixing stage for reconstructing the at least one channel of the multichannel input signal from the two-channel output signal.

In some example embodiments, the first set of mixing parameters may comprise at least four mixing parameters, and the second set of mixing parameters may be at least twice as many as the number of channels in the at least one channel of the multichannel input signal. By outputting at least twice as many mixing parameters as the number of channels in the multichannel input signal to be reconstructed, the encoding system may facilitate reconstruction of the multichannel input signal in a decoding system, e.g. comprising two or more independently operating parametric mixing stages. In particular, each such mixing stage may fulfill its tasks without interaction with the neighboring parallel mixing stages in the decoding system. For example, it is not necessary for neighboring mixing stages to poll each other for values of the mixing parameters, nor to exchange or share intermediate signals. This allows for a high degree of modularity and/or parallelization.

According to an example embodiment, the parameters of the first and second sets of mixing parameters may be real-valued, i.e. the parameters may be real numbers.

According to an example embodiment, the parameter analyzer may be further adapted to output an additional mixing parameter, based on the multichannel input signal, for controlling contributions of an additional decorrelated signal to output channels of the first and second parametric mixing stages.

Decorrelators may be used when reconstructing a higher number of channels from a lower number of channels, using mixing parameters. The mixing parameters may for example be adapted for use in parametric mixing stages employing decorrelators to reconstruct channels of the multichannel input signal. By providing an additional mixing parameter, for controlling contributions of an additional decorrelated signal to output channels of a first and second parametric mixing stage, the encoding system enables or at least facilitates a more faithful reconstruction of the multichannel audio signal, in a decoding system comprising the parametric mixing stages.

Further example embodiments are defined in the dependent claims. It is noted that the invention relates to all combinations of features, even if re-cited in mutually different claims.

II. Example Embodiments

FIG. 1 is a generalized block diagram of an audio decoding system 100 for processing a two-channel input signal X. The audio decoding system 100 comprises a parametric mixing stage 110 which is adapted to receive the two-channel input signal X and to receive a set of mixing parameters P1 including at least four independently assignable mixing parameters. In other words, the set of mixing parameters P1 may include more than four mixing parameters, but at least four of these mixing parameters are mutually independent parameters (i.e. independent in relation to each other). The parametric mixing stage 110 is adapted to output a two-channel output signal Y1 based on the two-channel input signal X and the set of mixing parameters P1. The parametric mixing stage 110 comprises a decorrelation stage 111 and a mixing matrix 112. The decorrelation stage 111 is adapted to output a decorrelated signal D1 based on the input signal X. In FIG. 1, the decorrelated signal D1 is exemplified by a one-channel signal, but in some example embodiments the decorrelated signal D1 may comprise a plurality of channels. For example, the decorrelated signal D1 may be a two-channel signal like the input signal X.

The mixing matrix 112 is adapted to receive the input signal X and the decorrelated signal D1. The mixing matrix 112 is further adapted to form a two-channel linear combination of the channels from the input signal X and the channel (or channels) from the decorrelated signal D1, and to output this linear combination as the two-channel output signal Y1. The mixing matrix 112 is adapted to form this linear combination using the set of parameters P1, i.e. at least some of the coefficients of the linear combination (e.g. all of the coefficients) are controllable by the set of mixing parameters P1.

In some example implementations of the structure depicted in FIG. 1, the decorrelation stage 111 may form the decorrelated signal D1 using the set of parameters P1 (or using a subset of the set of parameters P1). For example, the decorrelation stage 111 may comprise a premixing matrix 113 adapted to form an intermediate linear combination Z1 of the two channels from the input signal X, wherein at least some of the coefficients (e.g. all of the coefficients) of this intermediate linear combination Z1 are controllable by one or more of the parameters in the set of mixing parameters P1. In the present example, the decorrelation stage 111 may further comprise a decorrelator 114 adapted to receive the intermediate linear combination Z1 and to output, based thereon, the decorrelated signal D1. The decorrelated signal D1 may for example be delayed, phase shifted and/or processed by a reverb-type effect. Several decorrelator designs are known in the art. See for instance the patents documents EP 1 410 687 B1 and EP 1 616 461 B1 for example designs that may be used as the decorrelator 114. In some example embodiments, the intermediate linear combination Z1 may be a one-channel signal and the decorrelator 114 may output a one-channel decorrelated signal D1. In other embodiments, the intermediate linear combination Z1 may be a multichannel signal, and the decorrelator 114 may comprise several sub-decorrelators, each outputting one channel of a multichannel decorrelated signal D1, based on a respective channel of the intermediate linear combination Z1.

In particular, the decorrelator 114 may comprise one or more infinite impulse response lattice filters adapted to receive a channel of the intermediate linear combination Z1 and to output a channel of the decorrelated signal D1. Further, the decorrelator 114 may for example comprise an artifact attenuator configured to detect sound endings in the intermediate linear combination Z1 and to take corrective action in response thereto. In case the input signal X goes silent after a period with active audio content, transients and/or other artifacts may be detectible by the human ear in the in the output signal Y1. By for example attenuating the intermediate audio signal Z1 in the beginning of such silent periods in the input signal X, the decorrelator 114 may reduce the impact of transients and/or other artifacts in the decorrelated signal D1 and in the output signal Y1.

The intermediate linear combination Z1 may be represented as the result of a matrix A being applied to the input signal X. The decorrelated signal D1 may be expressed as $$D1=\mathrm{Dec}(AX),$$

where Dec( ) denotes decorrelation performed by the decorrelator 114. Note that Dec( ) denotes element-wise decorrelation in case AX is a multichannel signal. The output signal Y1 may be expressed as the result of a matrix B being applied to the input signal X and the decorrelated signal D1, i.e. as $$Y1 = B\begin{pmatrix} X \\ D1 \end{pmatrix}.$$

In some example implementations of the structure depicted in FIG. 1, the parametric mixing stage 110 may be adapted to receive values of the set of mixing parameters P1 associated with a plurality of frequency subbands, and to operate on frequency subband representations of the input signal X and the decorrelated signal D1 using values of the set of mixing parameters P1 associated with the corresponding frequency subbands. Similarly, the premixing matrix 113 may be adapted to operate on frequency subband representations of the input signal X. The input signal X may for example be received in a transformed format (e.g. using Quadrature Mirror Filtering, QMF) in which it is represented in frequency subbands associated with the transform (e.g. QMF subbands). Received values of the mixing parameters may be associated with frequency subbands having a different frequency resolution than the transform subbands of the input signal X. The received values of the mixing parameters may in this case be mapped to the appropriate transform subbands (e.g. QMF subbands), in particular by grouping two or more QMF subbands together and applying the same values of the mixing parameters for these two or more QMF subbands.

The parametric mixing stage 110 may for example employ a non-uniform frequency subband partition. For example, the subbands may reflect the sensitivity of the human hearing system, the subband partition being finer for frequency ranges in which the human ear is relatively more sensitive, which is typically lower and middle frequencies.

In some example embodiments, the parametric mixing stage 110 may be adapted to receive the input signal X having a first time resolution in which it is divided into time frames comprising a constant number of samples (i.e. the same number of samples in each frame). In such embodiments, the parametric mixing stage 110 may be operable to receive, during a time frame, one or more values of each of the set of mixing parameters P1 (for details, see the description of FIGS. 2*a-d* below). The input signal X may for example be received by the audio decoding system 100 in MDCT-coded format (Modified Discrete Cosine Transform) and the time frames may be MDCT frames with a length corresponding to the stride of the MDCT transform.

Denoting the current frequency subband by an index k and the current sample (e.g. QMF sample) by an index n, the decorrelated signal D1 and the output signal Y1 may be expressed as $$D1(n,k) = Dec(A(n,k)X(n,k)) \text{ and } Y1(n,k) = B(n,k)\begin{bmatrix} X(n,k) \\ D1(n,k) \end{bmatrix}.$$

The elements of the matrices A(n, k) and B(n, k), which are used as coefficients during mixing (and premixing), may for example be controlled by the values of the set of mixing parameters P1 for the corresponding frequency subband and sample. In some example embodiments, the matrices A(n, k) and B(n, k) may be obtained as time-interpolated versions of matrices E and F, respectively. Examples of the matrices E and F will be described in different scenarios below. Different time interpolation schemes for obtaining the matrices A(n, k) and B(n, k) from the matrices E and F will be described later in relation to FIGS. 2*a-d*.

In a first scenario, the input signal X represents a stereo audio signal in a compressed format. The left and right channels of the stereo audio signal are coded in the input signal X as a one-channel downmix signal accompanied in the input signal X by an empty (or zero/neutral) channel. Assuming the downmix signal of the present scenario is located as the first channel in the input signal X, the decoding system 100 may employ the values set forth in matrices $$E = (1\ 0) \text{ and } F = \begin{pmatrix} (1+\alpha 1)/2 & 0 & \beta 1/2 \\ (1-\alpha 1)/2 & 0 & -\beta 1/2 \end{pmatrix}.$$

in the premixing matrix 113 and the mixing matrix 112, respectively, to reconstruct the stereo audio signal. The matrices E and F above may be seen as an example implementation of more general matrices $$E = (\gamma 1\ \gamma 2) \text{ and } F = \begin{pmatrix} \gamma 1(1+\alpha 1)/2 & \gamma 2(1+\alpha 1)/2 & \beta 1/2 \\ \gamma 1(1-\alpha 1)/2 & \gamma 2(1-\alpha 1)/2 & -\beta 1/2 \end{pmatrix},$$

to be used in the premixing matrix 113 and the mixing matrix 112, respectively. The general matrices E and F are parameterized by the set P1 of parameters ($\alpha$1, $\beta$1, $\gamma$1, $\gamma$2), i.e. exactly four parameters which are independently assignable. In particular, the coefficients of the intermediate linear combination Z1 obtained in the premixing matrix 113 by using the matrix E are controlled by the set P1 of parameters ($\alpha$1, $\beta$1, $\gamma$1, $\gamma$2) only, i.e. no other parameters contribute to the control of the coefficients employed by the premixing matrix 113.

In the first scenario described above, the set of mixing parameters P1 is ($\alpha$1, $\beta$1, $\gamma$1, $\gamma$2), but the matrices E and F have been simplified by the use of the mixing parameter values $\gamma$1=1 and $\gamma$2=0.

In implementations of the structure depicted in FIG. 1, the actual values of the set of mixing parameters P1 may be received by the decoding system 100 together with the input signal X, e.g. encoded together with the input signal X in a bitstream. The set of mixing parameters P1 may for example have been determined in an encoding system in which the input signal X may have been created based on the stereo audio signal. See for example the encoder described in relation to FIG. 7.

The parameters in the set of mixing parameters P1 may have different roles and may therefore be received in different quantized formats (e.g. using different quantization scales). In the above scenario, the parameters $\alpha$1 and $\beta$1 control the distribution of signal components between the two output signal channels, while the parameters $\gamma$1 and $\gamma$2 control the relative contribution of the input signal X channels in the output signal Y1. Hence, different statistics may be expected for $\alpha$1 and $\beta$1 compared to the parameters $\gamma$1 and $\gamma$2. The parameters $\gamma$1 and $\gamma$2 may therefore be received in a different quantized format than the parameters $\alpha 1$ and $\beta 1$, while the parameters $\alpha 1$ and $\beta 1$ may in some example implementations be received in similar quantized formats.

In a second scenario, the input signal X is a two-channel representation of a stereo audio signal wherein the left (l) and right (r) channels of the stereo audio signal have been coded as a sum signal (l+r)/2 and a difference signal (l−r)/2 in the input signal X, for frequency bands below a crossover frequency, and as a one-channel downmix signal accompanied in the input signal X by an empty (or zero/neutral) channel, for frequency bands above the crossover frequency. In this second scenario, the decoding system 100 may for example receive an indication of the current crossover frequency, and may use the same matrices as in the first scenario, i.e.

$$E = (1\ 0) \text{ and } F = \begin{pmatrix} (1+\alpha 1)/2 & 0 & \beta 1/2 \\ (1-\alpha 1)/2 & 0 & -\beta 1/2 \end{pmatrix},$$

for frequency bands above this crossover frequency. For frequency bands below the crossover frequency, a certain discrete mode of the mixing stage 110 may be used in which the matrices $$E = (1\ 0) \text{ and } F = \begin{pmatrix} 1 & 1 & 0 \\ 1 & -1 & 0 \end{pmatrix}$$

are used to reconstruct the stereo audio signal. Although no decorrelation may be needed for frequency bands below the cross over frequency, it may be convenient to employ the same matrix E for frequency bands both below and above the crossover frequency.

Different time interpolation schemes for obtaining the matrices A(n, k) and B(n, k) from the matrices E and F, respectively, will now be described in relation to FIGS. 2*a-d*. It is to be noted that the interpolation schemes described below are expressed in terms of values of mixing parameters controlling the matrices E and F. Example embodiments are also envisaged in which analogous interpolation schemes (e.g. linear interpolation) are performed for matrix elements directly, rather than for parameter values controlling the matrix elements.

Figure 2:
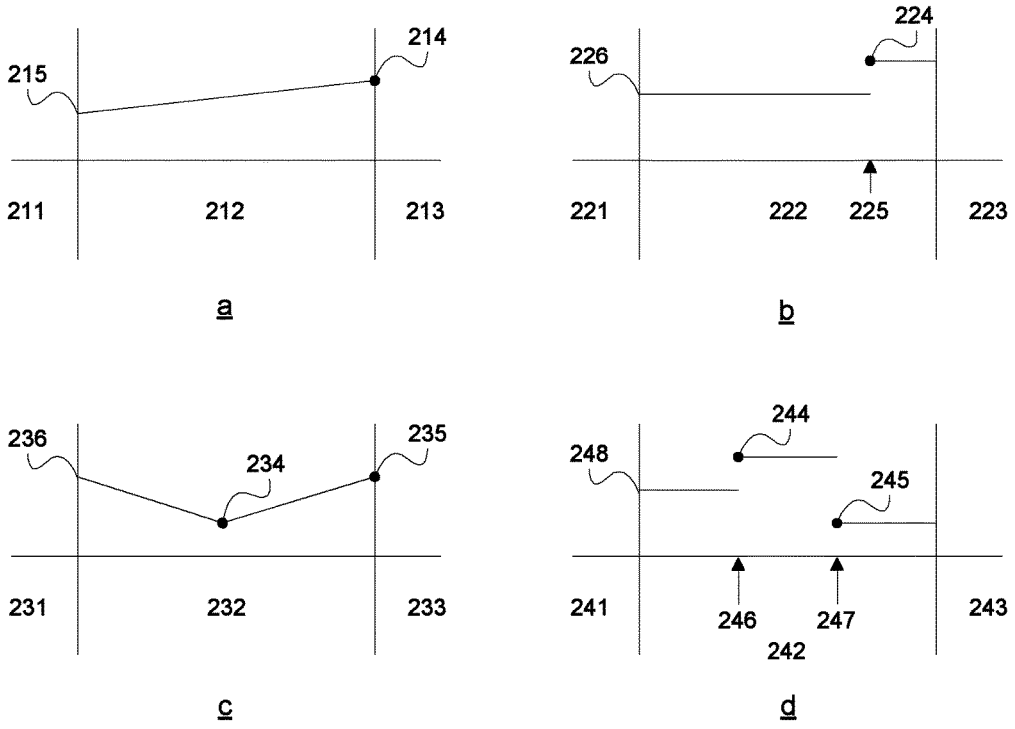
FIGS. 2*a-d* illustrate different forms of interpolation of mixing parameter values in accordance with at least some example embodiments.

In some implementations of the example embodiment depicted in FIG. 1, the parametric mixing stage 110 may be adapted to receive the input signal X having a first time resolution in which it is divided into time frames 211-213, 221-223, 231-233, 241-243 comprising a constant number of samples (i.e. each frame comprising the same number of samples). As illustrated in FIG. 2*a*, the parametric mixing stage 110 may in some example embodiments be operable to receive, during a time frame 212 (or 222 in FIG. 2*b*), one value 214 (or 224 in FIG. 2*b*) of each of the set of mixing parameters P1. As illustrated in FIG. 2*c*, the parametric mixing stage 110 may in some example embodiments be operable to receive, during a time frame 232 (or 242 in FIG. 2*d*), two values 234, 235 (or 244, 245 in FIG. 2*d*) of each of the set of mixing parameters P1. In some embodiments, the parametric mixing stage 110 may be operable to receive one value 214 in some frames 212 and two values 234, 235 in some frames 232, e.g. depending on whether two values 234, 235 are available or not, or depending on a certain received signal indicating the appropriate parameter format to be received by the parametric mixing stage 110. For clarity, it is pointed out that each parameter value may be received/obtained as a vector of values, each associated with a particular frequency band.

In some implementations of the example embodiment depicted in FIG. 1, the parametric mixing stage 110 may be operable to receive the set of mixing parameters P1 having the first time resolution (e.g. one or two sets of parameter values per time frame), and to employ interpolation over time to produce a set of one or more mixing parameters having a second time resolution (e.g. one set of values for each sample in each time frame) from the set of mixing parameters P1 having the first time resolution. This is illustrated in FIGS. 2*a* and 2*c* in which smooth interpolation is employed. In FIG. 2*a*, one set of values 214 of the mixing parameters P1 is received at the end of the time frame 212, and linear interpolation is made (for fractional values of the frame index, i.e. for the samples in the time frames) between these values 214 and the corresponding values 215 from the previous frame 211. In FIG. 2*c*, two sets of values 234, 235 of the mixing parameters P1 are received, one in middle and one at the end of the time frame 232. Linear interpolation is made between the latest set of values 236 from the previous frame 231 and the first received set of values 334 in the current fame 232, and then between the first 234 and second 235 received sets of values of the current frame 232.

In FIGS. 2*b* and 2*d*, steep interpolation is illustrated as an alternative to the smooth interpolation depicted in FIGS. 2*a* and 2*c*. In FIG. 2*b*, one set of values 224 is received at a position 225 in a frame 222. The latest value 226 of the previous frame 221 is used until the position 225 at which the new set of values 224 is received. At that position 225, the old values 226 are abandoned and the new values 224 are used until a new set of values is received. In FIG. 2*d*, two sets of values 244, 245 are received at positions 246 and 247, respectively, in the current frame 242. The latest set of values 248 of the previous frame 241 is used until the position 246 at which the first new set of values 244 is received. At that position 246, the old values 248 are abandoned and the first set of new values 244 is used until the position 247 at which the second set of values 245 is received.

Figure 3:
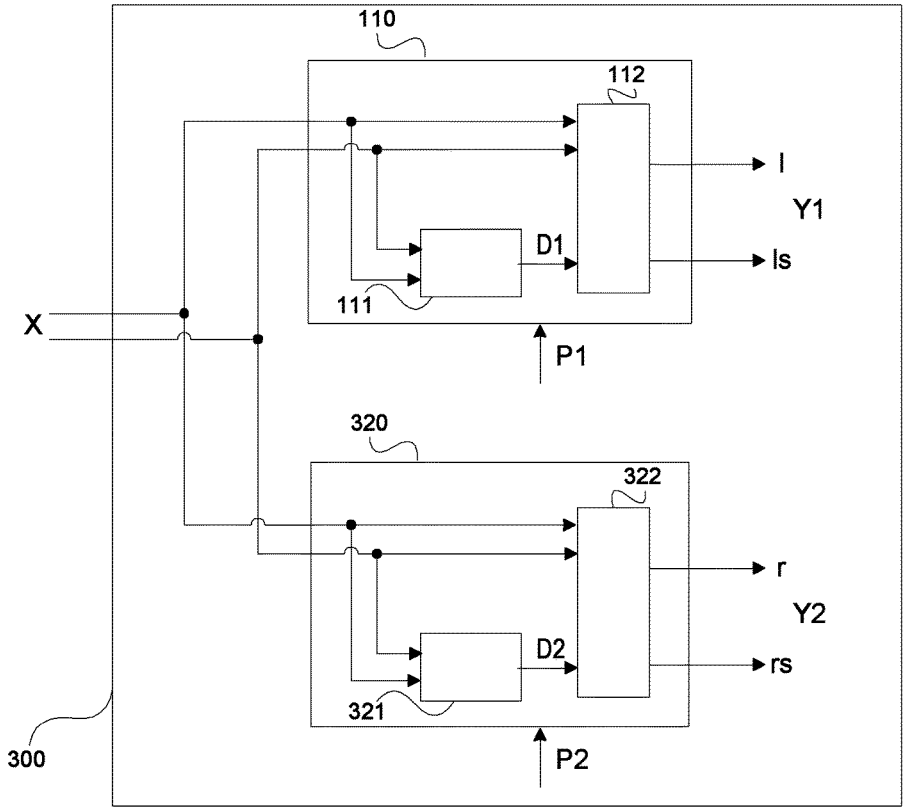
FIGS. 3 to 6 are generalized block diagrams of audio decoding systems in accordance with a second, a third, a fourth and a fifth example embodiment, respectively.

FIG. 3 is a generalized block diagram of an audio decoding system 300 in accordance with a second example embodiment. The decoding system 300 comprises a first parametric mixing stage 110 of the same type as the parametric mixing stage 110 of the decoding system 100 shown in FIG. 1. The decoding system 300 further comprises a second parametric mixing stage 320 which is functionally identical to the first mixing stage 110. The second parametric mixing stage 320 is adapted to receive the input signal X and a second set of mixing parameters P2, values of which the second parametric mixing stage 320 is configured to receive independently of the first set of mixing parameters P1 received by the first parametric mixing stage 110. Analogously to the first mixing stage 110, the second mixing stage 320 is adapted to output a second output signal Y2 based on the input signal X and the second set of mixing parameters P2. The second mixing stage 320 comprises a second decorrelation stage 321 adapted to output a second decorrelated signal D2 based on the input signal X. The second mixing stage 320 further comprises a second mixing matrix 322 adapted to receive the input signal X and the second decorrelated signal D2, to form a second two-channel linear combination of channels from the input signal and the second decorrelated signal D2, and to output the second linear combination as the second two-channel output signal Y2. At least some of the coefficients (e.g. all of the coefficients) of the second linear combination are controllable by the second set of mixing parameters P2 and at least four mixing parameters of the second set P2 are independently assignable in relation to each other.

The first and second parametric mixing stages 110, 320 shown in FIG. 3, are functionally equivalent. The first and second parametric mixing stages 110, 320 are distinguishable only by the values of the first set of parameters P1 and the second set of parameters P2, received by the first and second parametric mixing stages 110, 320, respectively. Moreover, the first and second parametric mixing stages 110, 320 operate in parallel and independently of each other.

As the decoding system 300 in FIG. 3 comprises two mixing stages 110 and 320, each providing its own two-channel output signal Y1 and Y2, the decoding system 300 may output a total of four channels based on the two-channel input signal X and the parameter sets P1 and P2. Analogously to the situation in first mixing stage 110, the second decorrelated signal D2 and the second output signal Y2 may be expressed as $$D2(n,k) = Dec(A(n,k)X(n,k)) \text{ and } Y(n,k) = B(n,k)\begin{bmatrix} X(n,k) \\ D1(n,k) \end{bmatrix},$$

wherein time interpolation schemes for obtaining the matrices A(n, k) and B(n, k) from matrices E and F may be analogous to those described in relation to FIGS. 2*a-d*. It is to be noted that different matrices A(n, k), B(n, k), E and F may typically be used for the first and second mixing stages 110 and 320 respectively, although the respective matrices may have a similar structure and/or parameterization.

In an example scenario for the structure depicted in FIG. 3, a multichannel audio signal comprising at least a left channel l, left surround channel ls, right channel r and right surround channel rs is to be reconstructed by the decoding system 300. The decoding system 300 receives a two-channel input signal X which is a downmixed representation of the multichannel audio signal. The first mixing stage 110 receives a first set P1 of mixing parameters ($\alpha 1$, $\beta 1$, $\gamma 1$, $\gamma 2$) and uses the coefficients set forth in the matrices $$E = (\gamma 1, \gamma 2) \text{ and } F = \begin{pmatrix} \gamma 1(1+\alpha 1)/2 & \gamma 2(1+\alpha 1)/2 & \beta 1/2 \\ \gamma 1(1-\alpha 1)/2 & \gamma 2(1-\alpha 1)/2 & -\beta 1/2 \end{pmatrix},$$

to reconstruct the left l and left surround ls channels from the input signal X. Similarly, the second mixing stage 320 receives a second set P2 of mixing parameters ($\alpha 1$, $\beta 1$, $\gamma 1$, $\gamma 2$) and uses the coefficients set forth in the matrices $$E = (\gamma 3, \gamma 4) \text{ and } F = \begin{pmatrix} \gamma 3(1+\alpha 2)/2 & \gamma 4(1+\alpha 2)/2 & \beta 2/2 \\ \gamma 3(1-\alpha 2)/2 & \gamma 4(1-\alpha 2)/2 & -\beta 2/2 \end{pmatrix},$$

to reconstruct the right r and right surround rs channels from the input signal X. In this way, the decoding system 300 may reconstruct the four channels (l, ls, r, rs) of the multichannel audio signal from a two-channel input signal using two sets P1, P2 of mixing parameters.

The actual values of the sets P1, P2 of mixing parameters may be received by the decoding system 300 together with the input signal X, e.g. encoded together with the input signal in a bitstream. The sets of mixing parameters may for example have been determined in an encoding system in which the input audio signal may have been created based on the multichannel audio signal comprising the four channels (c, l, ls, r, rs). See for example the description of the encoding system with reference to FIG. 7.

The parameters in the first set of mixing parameters P1 may have different roles and may therefore be received in different quantized formats (e.g. using different quantization scales). In the above scenario, the parameter $\beta 1$ controls the contribution of the first decorrelated signal D1 to the left channel l and the left surround channel ls and may typically assume values between 0 and 1. The parameter $\alpha 1$ controls panning, i.e. the balance between the left channel l and the left surround channel ls, and may for example assume values centered around 0. Different statistics than for $\alpha 1$ and $\beta 1$ may be expected for the parameters $\gamma 1$ and $\gamma 2$ controlling the balance between the channels of the input signal X in the output channels l, ls. The parameters $\gamma 1$ and $\gamma 2$ may therefore be received in a different quantized format than the parameters $\alpha 1$ and $\beta 1$, while the parameters $\alpha 1$ and $\beta 1$ may in some example implementations be received in similar quantized formats. Similarly for the second set of mixing parameters P2, the parameters $\gamma 3$ and $\gamma 4$ may be received in a different quantized format than the parameters $\alpha 2$ and $\beta 2$, while the parameters $\alpha 2$ and $\beta 2$ may in some example implementations be received in similar quantized formats.

Figure 4:
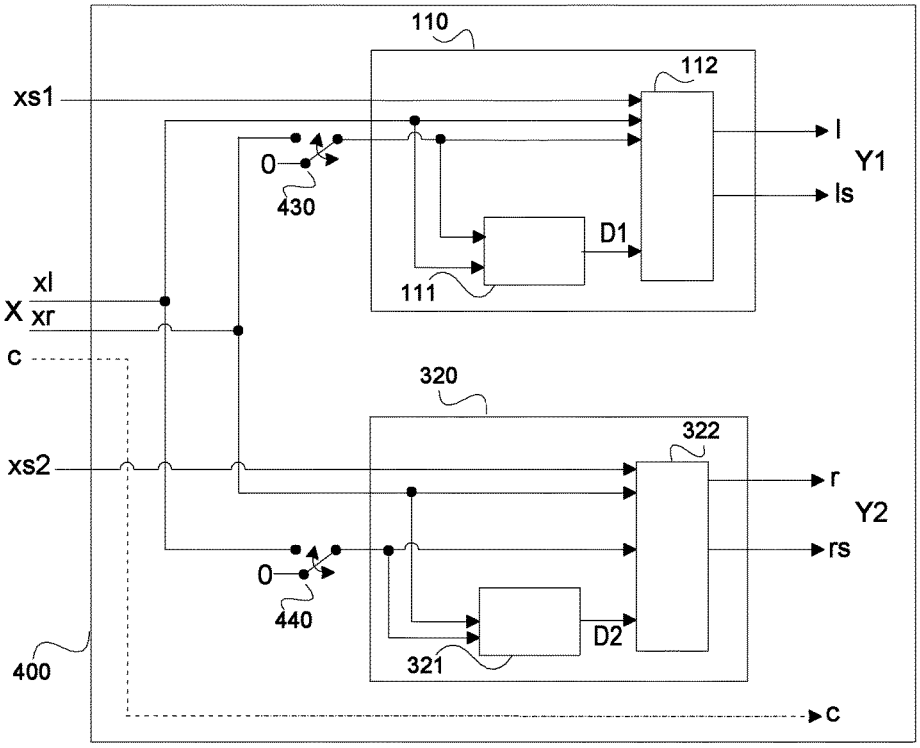

The different roles of the parameters in the first set of mixing parameters P1 may also be described as follows. Two independently assignable parameters $\gamma 1$ and $\gamma 2$, control relative contributions of the two input signal X channels to an intermediate linear combination Z1 (see FIG. 1), formed in the premixing matrix 113 of the first decorrelation stage 111 and which is decorrelated to form the first decorrelated signal D1 .These two parameters $\gamma 1$ and $\gamma 2$ may be received by the first mixing stage 110 in a first quantized format. Two different independently assignable parameters $\alpha 1$ and $\beta 1$ control relative contributions of the intermediate linear combination Z1 and the first decorrelated signal D1 to the first output signal Y1. As different statistics than for $\gamma 1$ and $\gamma 2$ may be expected for the parameters $\alpha 1$ and $\beta 1$, the latter two parameters $\alpha 1$ and $\beta 1$ may for example be received in a second quantized format, distinct from the first quantized format. FIG. 4 is a generalized block diagram of an audio decoding system 400 in accordance with a third example embodiment. The decoding system 400 is similar to the decoding system 300 shown in FIG. 3, i.e. comprising a first and a second parametric mixing stage 110, 320. However, in the present example embodiment, the first mixing matrix 112 is adapted to receive a first side signal xs1 comprising spectral data corresponding to frequencies up to a first crossover frequency, and the second mixing matrix 322 is adapted to receive a second side signal xs2 comprising spectral data corresponding to frequencies up to a second crossover frequency (e.g. equal to the first crossover frequency, or distinct from the first crossover frequency). In the present example embodiment, the side signals xs1, xs2 are used by the first and second mixing matrices 112, 322, respectively, when forming two-channel linear combinations to be output as the first and second output signals Y1, Y2. This will be described in the example scenario below.

In an example scenario, a five-channel audio signal comprising a center channel c, left channel l, left surround channel ls, right channel r and right surround channel rs is to be reconstructed by the decoding system 400. The decoding system 400 receives a left downmix signal xl representing the left l and left surround ls channels, and a first side signal xs1 comprising spectral data of the left l and left surround ls channels, corresponding to frequencies up to a first crossover frequency. More precisely, for frequencies below the first crossover frequency, the left l and left surround ls channels have been coded as a sum signal (l+ls)/2 and a difference signal (l−ls)/2 in the left downmix signal xl and the first side signal xs1, respectively. For frequency bands above the first crossover frequency, the left channel l and left surround channel ls are represented by the left downmix signal xl (and mixing parameters) only.

Similarly, the decoding system 400 receives a right downmix signal xr representing the right r and right surround rs channels, and a second side signal xs2 comprising spectral data of the right r and right surround rs channels, corresponding to frequencies up to a second crossover frequency. More precisely, for frequencies below the second crossover frequency, the right r and right surround rs channels have been coded as a sum signal (r+rs)/2 and a difference signal (r−rs)/2 in the right downmix signal xr and the second side signal xs2, respectively. For frequency bands above the second crossover frequency, the right channel r and right surround channel rs are represented by the right downmix signal xr (and mixing parameters) only.

In the present example scenario, the decoding system 400 also receives the center channel c of the five-channel audio signal, and may for example output it together with the other output signals (i.e. the first and second output signals Y1, Y2), without processing it.

The first mixing stage 110 is to reconstruct the left l and left surround ls channels based on the input signal X and the first side signal xs1. It may for example receive the left and right downmix signals xl and xr of the two-channel input signal X directly. However, the right downmix signal xr is not needed for reconstructing the left l and left surround ls channels and may be replaced by an empty or neutral channel in a preprocessor 430, before the input signal is received by the first mixing stage 110. By removing data which is not needed, unnecessary processing may be avoided, e.g. in the first decorrelation stage 111.

Analogously, as the second mixing stage 320 is to reconstruct the right r and right surround rs channels based on the input signal X and the second side signal xs2, and as the left downmix signal xl is not needed for reconstructing the right r and right surround rs channels, the left downmix signal xl may be replaced by an empty or neutral channel in a preprocessor 440, before the input signal is received by the second mixing stage 320.

In other words, example embodiments of the decoding system 400 are envisaged in which the first mixing stage 110 receives the left downmix signal xl and the first side signal xs1, while the second mixing stage 320 receives the right downmix signal xr and the second side signal xs2. In such example embodiments, the input of the first mixing stage 110 is independent of the input of the second mixing stage 320, and the reconstruction of the left l and left surround ls channels, by the first mixing stage 110 may be completely independent of the reconstruction of the right r and right surround rs channels by the second mixing stage 320.

In the example embodiment depicted in FIG. 4, the first mixing stage 110 may receive an indication of the first crossover frequency, and may employ the coefficients set forth in the matrices $$E = (1\ 0) \text{ and } F = \begin{pmatrix} (1+\alpha 1)/2 & 0 & \beta 1/2 \\ (1-\alpha 1)/2 & 0 & -\beta 1/2 \end{pmatrix},$$

for frequency bands above this first crossover frequency, to reconstruct the left l and left surround ls channels as the first output signal Y1. This corresponds to a first set P1 of mixing parameters (α1, β1, γ1=1, β2=0). It is to be recalled that the first decorrelated signal D1 and the first output signal Y1 may be expressed as $$D1(n,k) = Dec(A(n,k)X(n,k)) \text{ and } Y1(n,k) = B(n,k)\begin{bmatrix} X(n,k) \\ D1(n,k) \end{bmatrix}.$$

wherein the matrices A(n, k) and B(n, k) may be formed by time-interpolated versions of the matrices E and F.

For frequency bands below the first crossover frequency a certain discrete mode of the first mixing stage 110 may be used, in which also the first side signal xs1 is used by the first mixing matrix 112 to form the two-channel linear combination to be outputted as the first output signal Y1. This may expressed as $$D1(n,k) = Dec(A(n,k)X(n,k)) \text{ and } Y1(n,k) = B(n,k)\begin{bmatrix} X(n,k) \\ D1(n,k) \\ xs1(n,k) \end{bmatrix},$$

where an extra row has been added to the matrix B(n, k) to include the first side signal xs1 in the linear combination. In this discrete mode, the first mixing stage 110 may employ the coefficients set forth in the matrices $$E = (1\ 0) \text{ and } F = \begin{pmatrix} 1 & 0 & 0 & 1 \\ 1 & 0 & 0 & -1 \end{pmatrix},$$

to reconstruct the left l and left surround is channels as the first output signal Y1, where an extra column has been added to the matrix F to include the first side signal xs1 in the linear combination. Although no decorrelation is needed for frequency band below the first crossover frequency, it may be convenient to employ the same matrix E for frequency bands both below and above the first crossover frequency.

Analogously to the first mixing matrix 110, the second mixing matrix 320 may receive an indication of the second crossover frequency, and may employ the coefficients set forth in the matrices $$E = (1\ 0) \text{ and } F = \begin{pmatrix} (1+\alpha 2)/2 & 0 & \beta 2/2 \\ (1-\alpha 2)/2 & 0 & -\beta 2/2 \end{pmatrix},$$

for frequency bands above this second crossover frequency, to reconstruct the right r and right surround rs channels as the second output signal Y2. This corresponds to a second set P2 of mixing parameters (α2, β2, γ3=1, γ4=0). For frequency bands below the second crossover frequency a certain discrete mode of the second mixing stage 320 may be used, in which also the second side signal xs2 is used by the second mixing matrix 322 to form the two-channel linear combination to be outputted as the second output signal Y2. This may expressed as $$D2(n,k) = Dec(A(n,k)X(n,k)) \text{ and } Y2(n,k) = B(n,k)\begin{bmatrix} X(n,k) \\ D2(n,k) \\ xs2(n,k) \end{bmatrix},$$

where an extra row has been added to the matrix B(n, k) to include the second side signal xs2 in the linear combination. In this discrete mode, the second mixing stage 320 may employ the coefficients set forth in the matrices $$E = (1\ 0) \text{ and } F = \begin{pmatrix} 1 & 0 & 0 & 1 \\ 1 & 0 & 0 & -1 \end{pmatrix},$$

to reconstruct the right r and right surround rs channels as the second output signal Y2, where an extra column has been added to the matrix F to include the first side signal xs1 in the linear combination. It is to be noted that the matrix E above is adapted for a situation in which the right downmix signal xr is received by the second mixing matrix 322 as the first channel of the two input channels. For example, the first two columns of the matrix E may be switched for a situation in which the right downmix signal xr is received by the second mixing matrix 322 as the second channel of the two input channels.

In the way described above, the decoding system 400 may reconstruct a five-channel signal (c, l, ls, r, rs) from a three-channel downmixed representation (xl, xr, c) accompanied by the first and second side signals xs1, xs2. The actual values of the sets P1 and P2 of mixing parameters may be received by the decoding system 400 together with the input signal X (and the side signals), e.g. encoded together with the input signal X (and the side signals) in a bitstream. The first P1 and second P2 sets of mixing parameters may for example have been determined in an encoding system in which the input audio signal may have been created based on the five-channel audio signal (c, l, ls, r, rs). See for example the description of the encoding system with reference to FIG. 7.

Figure 5:
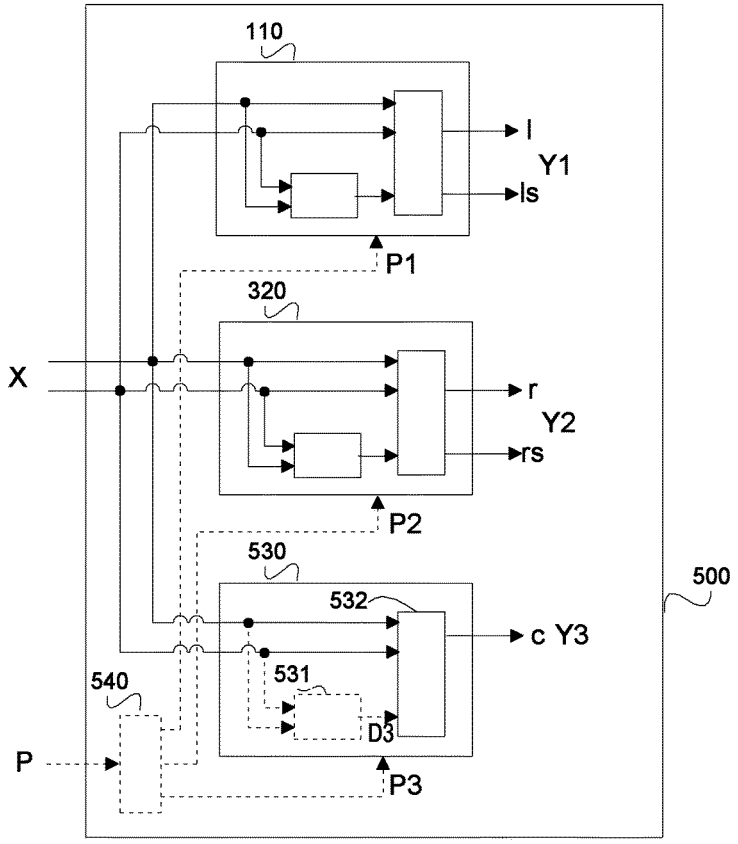

FIG. 5 is a generalized block diagram of an audio decoding system 500 in accordance with a fourth example embodiment. The decoding system 500 comprises a first parametric mixing stage 110 and a second parametric mixing stage 320, similarly to the decoding system 300 in FIG. 3, but the decoding system 500 in FIG. 5 further comprises a third parametric mixing stage 530. The third parametric mixing stage 530 is adapted to receive the two-channel input signal X and to receive a third set of mixing parameters P3 independent of the first P1 and second P2 sets of mixing parameters.

In a first example implementation of the example embodiment depicted in FIG. 5, the third parametric mixing stage 530 is adapted to output a third output signal Y3, wherein at most one channel comprises audio content independent from that of any other channel or channels of the third output signal Y3. For example, the third output signal Y3 may be a two-channel signal, similar to the first and second output signals Y1 and Y2 of the first and second mixing stages 110 and 320, but where one of the channels is empty (or zero/neutral). In other example embodiments, the third output signal Y3 may comprise exactly one channel.

In a second example implementation of the example embodiment depicted in FIG. 5, the decoding system 500 may comprise a controller 540 adapted to receive a collection of parameters P. The controller 540 may be adapted to supply the first, second and third sets of parameters P1, P2, P3, being subsets of the collection of parameters P, to the first, second and third parametric mixing stages 110, 320, 530, respectively. The controller 540 may be further adapted to control the third parametric mixing stage 530, via the third set of mixing parameters P3, to provide at most one channel with independent audio content in the third output signal Y3. The controller 540 may for example be a demultiplexer extracting the first P1, second P2 and third P3 sets of mixing parameters from a bitstream (not shown) and supplying the first P1, second P2 and third P3 sets of mixing parameters to the first 110, second 320 and third 530 mixing stages, respectively. By supplying parameters for reconstruction of a single channel (accompanied by an empty/neutral channel), a demultiplexer (or controller 540) may control the third parametric mixing stage 530 in such a manner that it provides at most one channel with independent audio content in the third output signal Y3. In some example implementations, a demultiplexer (not shown) may receive a bitstream (not shown) from which it extracts the input signal X and the sets of mixing parameters P1, P2, P3. The demultiplexer may supply the input signal X and the sets of mixing parameters P1, P2, P3 to the appropriate mixing stages 110, 320, 530 and by supplying parameters for reconstruction of a single channel (possibly accompanied by an empty/neutral channel), a demultiplexer (or controller 540) may control the third parametric mixing stage 530 to provide at most one channel with independent audio content in the third output signal Y3. Parameters for reconstruction of a single channel may for example assume values causing coefficients of a linear combination to be performed in the third mixing stage 530, and to be output as the third output signal Y3, to be zero.

In the decoding system 500 depicted in FIG. 5, the third parametric mixing stage 530 comprises a third mixing matrix 532 which is adapted to receive the input signal X and to form a third linear combination of channels from the input signal X. The third parametric mixing stage 530 is adapted to output this third linear combination as the third output signal Y3. At least some of the coefficients (e.g. all of the coefficients) of this third linear combination are controllable by the third set of mixing parameters P3, and at least two of the mixing parameters of the third set P3 are independently assignable in relation to each other.

In some implementations of the decoding system 500 depicted in FIG. 5, the third parametric mixing stage 530 may be analogous to the first and second parametric mixing stages 110 and 320, i.e. it may comprise a third decorrelation stage 531 outputting a third decorrelated signal D3 based on the input signal X, and the third decorrelated signal D3 may be used in the third linear combination formed in the third mixing matrix 532.

Analogously to the situation in first and second mixing stages 110 and 320, the third decorrelated signal D3 and the third output signal Y3 may be expressed as $$D3(n,k) = Dec(A(n,k)X(n,k)) \text{ and } Y3(n,k) = B(n,k)\begin{bmatrix} X(n,k) \\ D3(n,k) \end{bmatrix}$$

wherein time interpolation schemes for obtaining the matrices A(n, k) and B(n, k) from matrices E and F may be analogous to those described in relation to FIGS. 2*a-d*. It is to be noted that different matrices A(n, k), B(n, k), E and F may typically be used for the first, second and third mixing stages 110, 320 and 530 respectively, although at least some of the respective matrices may have a similar structure and/or parameterization.

In an example scenario for the structure depicted in FIG. 5, a five-channel audio signal comprising a center channel c, left channel l, left surround channel ls, right channel r and right surround channel rs is to be reconstructed by the decoding system 500. The decoding system 500 receives a two-channel input signal X which is a downmixed representation of the five-channel audio signal. The first mixing stage 110 receives a first set P1 of mixing parameters ($\alpha$1, $\beta$1, $\gamma$1, $\gamma$2) and uses the coefficients set forth in the matrices $$E = (\gamma 1, \gamma 2) \text{ and } F = \begin{pmatrix} \gamma 1(1+\alpha 1)/2 & \gamma 2(1+\alpha 1)/2 & \beta 1/2 \\ \gamma 1(1-\alpha 1)/2 & \gamma 2(1-\alpha 1)/2 & -\beta 1/2 \end{pmatrix},$$

to reconstruct the left l and left surround is channels from the input signal X. Similarly, the second mixing stage 320 receives a second set P2 of mixing parameters ($\alpha$2, $\beta$2, $\gamma$3, $\gamma$4) and uses the coefficients set forth in the matrices $$E = (\gamma 3, \gamma 4) \text{ and } F = \begin{pmatrix} \gamma 3(1+\alpha 2)/2 & \gamma 4(1+\alpha 2)/2 & \beta 2/2 \\ \gamma 3(1-\alpha 2)/2 & \gamma 4(1-\alpha 2)/2 & -\beta 2/2 \end{pmatrix},$$

to reconstruct the right r and right surround rs channels from the input signal X. The third mixing stage receives a third set P3 of mixing parameters ($\alpha$3=1, $\beta$3=0, $\gamma$5, $\gamma$6) and uses coefficients set forth in the matrices $$E = (\gamma 5, \gamma 6) \text{ and } F = \begin{pmatrix} \gamma 5 & \gamma 6 & 0 \\ 0 & 0 & 0 \end{pmatrix}$$

to reconstruct the center channel c from the input signal X. Note that these parameter values ($\alpha$3=1, $\beta$=0, $\gamma$5, $\gamma$6) causes the second channel of the third output signal Y3 to be zero. In an example implementation of the decoding system 500 depicted in FIG. 5, these parameter values may be provided by a controller 540 controlling the third parametric mixing stage 530, via the third set of parameters P3, to provide at most one channel with independent audio content in the third output signal Y3.

As outlined in the example scenario above, the decoding system 500 may reconstruct a five-channel signal (c, l, ls, r, rs) from a two-channel input signal using three sets P1, P2 and P3 of mixing parameters. It is to be noted that since $\beta$3=0, the third decorrelated signal D3 is not used when forming the third output signal Y3. Hence, the third decorrelation stage 531 is not needed. The third decorrelation stage 531 may therefore be omitted altogether, or may employ zeros as coefficients, instead of $\gamma$5 and $\gamma$6.

The actual values of the sets P1, P2 and P3 of mixing parameters may be received by the decoding system 500 together with the input signal X, e.g. encoded together with the input signal in a bitstream. The sets of mixing parameters may for example have been determined in an encoding system in which the input audio signal may have been created based on the five-channel signal (c, l, ls, r, rs). See for example the description of the encoding system with reference to FIG. 7.

Figure 6:
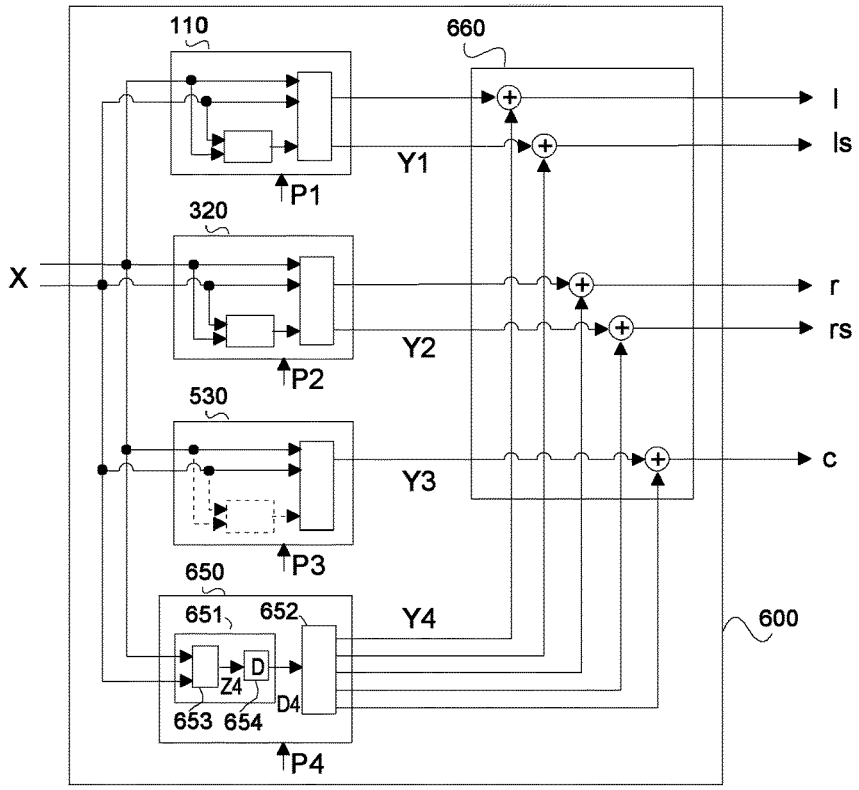

FIG. 6 is a generalized block diagram of an audio decoding system 600 in accordance with a fifth example embodiment. The decoding system 600 is similar to the decoding system 500 in FIG. 5, but it further comprises an additional parametric mixing stage 650 adapted to receive the two-channel input signal X and an extended set of mixing parameters P4 comprising at least three mixing parameters from the first set of mixing parameters P1, at least three mixing parameters from the second set of mixing parameters P2, and at least one additional mixing parameter independent of the first, second and third sets of mixing parameters P1, P2 and P3. The additional parametric mixing stage 650 is adapted to output an additional output signal Y4 having at least five channels and the decoding system 600 comprises a summing stage 660 adapted to add channels of the additional output signal Y4 to channels of the first output signal Y1, the second output signal Y2 and the third output signal Y3, respectively.

The additional parametric 650 stage comprises an additional decorrelation stage 651 adapted to output an additional decorrelated signal D4 based on the input signal X. The additional parametric stage 650 further comprises an upmix matrix 652 adapted to generate the additional output signal Y4 based on the additional decorrelated signal D4 and the extended set of mixing parameters P4.

In some example embodiments, the structure of the additional decorrelation stage 651 may be similar to the structure of the first decorrelation stage 111 depicted in FIG. 1, i.e. it may comprise an additional premixing matrix 653 forming an additional intermediate linear combination z4 based on the input signal X and the extended set of parameters P4. The additional decorrelation stage 651 may further comprise an additional decorrelator 654 forming the additional decorrelated signal D4 based on the additional intermediate linear combination z4.

Analogously to the situation in the previously described parametric mixing stages 110, 320 and 530, the additional decorrelated signal D4 and the additional output signal Y4 may be expressed as $$D4(n,k) = Dec(A(n,k)X(n,k)) \text{ and } Y4(n,k) = B(n,k)\begin{bmatrix} X(n,k) \\ D4(n,k) \end{bmatrix},$$

wherein time interpolation schemes for obtaining the matrices A(n, k) and B(n, k) from matrices E and F may be analogous to those described in relation to FIGS. 2*a-d*. It is to be noted that different matrices A(n, k), B(n, k), E and F may typically be used for the different mixing stages 110, 320, 530 and 650 respectively, although at least some of the respective matrices may have a similar structure and/or parameterization.

In an example scenario, similar to the scenario described with reference to FIG. 5, the first 110 second 320 and third 530 parametric mixing stages use parameters ($\alpha$1, $\beta$1, $\gamma$1, $\gamma$2), ($\alpha$2, $\beta$2, $\gamma$3, $\gamma$4) and ($\alpha$3, $\beta$3, $\gamma$5, $\gamma$6), respectively, to form a first Y1, second Y2 and third Y3 output signal, the channels of these output signals being adapted to create the impression of a five-channel audio signal (c, l, ls, r, rs). In the present scenario, however, the additional parametric mixing stage 650 is used to form additive contributions Y4 to the output signals Y1, Y2 and Y3, to be added to the two channels of the first output signal Y1, to the two channels of the second output signal Y2, and to the only channel of the output signal Y3, respectively. In this way, five modified output channels are created which may be used to create the impression of a five-channel audio signal (c, l, ls, r, rs).

In the present scenario, the additional parametric mixing stage 650 receives an extended set P4 of mixing parameters ($\alpha$1, $\alpha$2, $\gamma$1, $\gamma$2, $\gamma$3, $\gamma$4, $\delta$) and uses the coefficients set forth in the matrices $$E = (\gamma 1 + \gamma 3,\ \gamma 2 + \gamma 4) \text{ and } F = \begin{pmatrix} \delta(1+\alpha 1)/4 \\ \delta(1-\alpha 1)/4 \\ \delta(1+\alpha 2)/4 \\ \delta(1-\alpha 2)/4 \\ -\delta/2 \end{pmatrix},$$

in the additional decorrelation stage 651 and the additional mixing matrix 652, respectively, to form the additional decorrelated signal D4 and the additional output signal Y4. With this choice of the matrix E, the input to the additional decorrelation stage 651 is the sum of the inputs to the first and second decorrelation stages 111, 321. In particular, there is no contribution from an estimated center channel in the input to the additional decorrelation stage 651, which may reduce potential leakage of the center channel to surround channels. The actual values of the mixing parameters ($\alpha$1, $\alpha$2, $\gamma$1, $\gamma$2, $\gamma$3, $\gamma$4, $\delta$) may be received by the decoding system 600 together with the input signal X, e.g. encoded together with the input signal X in a bitstream. The sets of mixing parameters may for example have been determined in an encoding system in which the input audio signal may have been created based on the five-channel audio signal (c, l, ls, r, rs). See for example the encoding system described with reference to FIG. 7.

It is to be noted that additional scenarios are envisaged in which the extended set of parameters P4 may be ($\alpha$1, $\alpha$2, $\gamma$1, $\gamma$2, $\gamma$3, $\gamma$4, $\gamma$5, $\gamma$6, $\delta$) or ($\alpha$1, $\alpha$2, $\gamma$1, $\gamma$2, $\gamma$3, $\gamma$4, $\gamma$5, $\gamma$6, t, $\delta$). In order to arrive at a more restricted range of the $\delta$ parameter, the above matrix E may be replaced by a matrix E of the form $$E=(\gamma 1+\gamma 3+t\gamma 5,\ \gamma 2+\gamma 4+t\gamma 6),$$

with a parameter t in the range from 0 to 2. Alternatively, fixed matrices such as E=(1, 1) or E=(1, −1) can be used.

It is to be noted that other embodiments of decoding systems than those illustrated in FIGS. 1, 3, 4, 5 and 6, are also envisaged. In particular, any combination of parametric mixing stages of the types illustrated in these figures may be formed and used in other example decoding systems, e.g. to reconstruct a six-channel signal, or a seven-channel signal from the two-channel input signal using different sets of mixing parameters.

Figure 7:
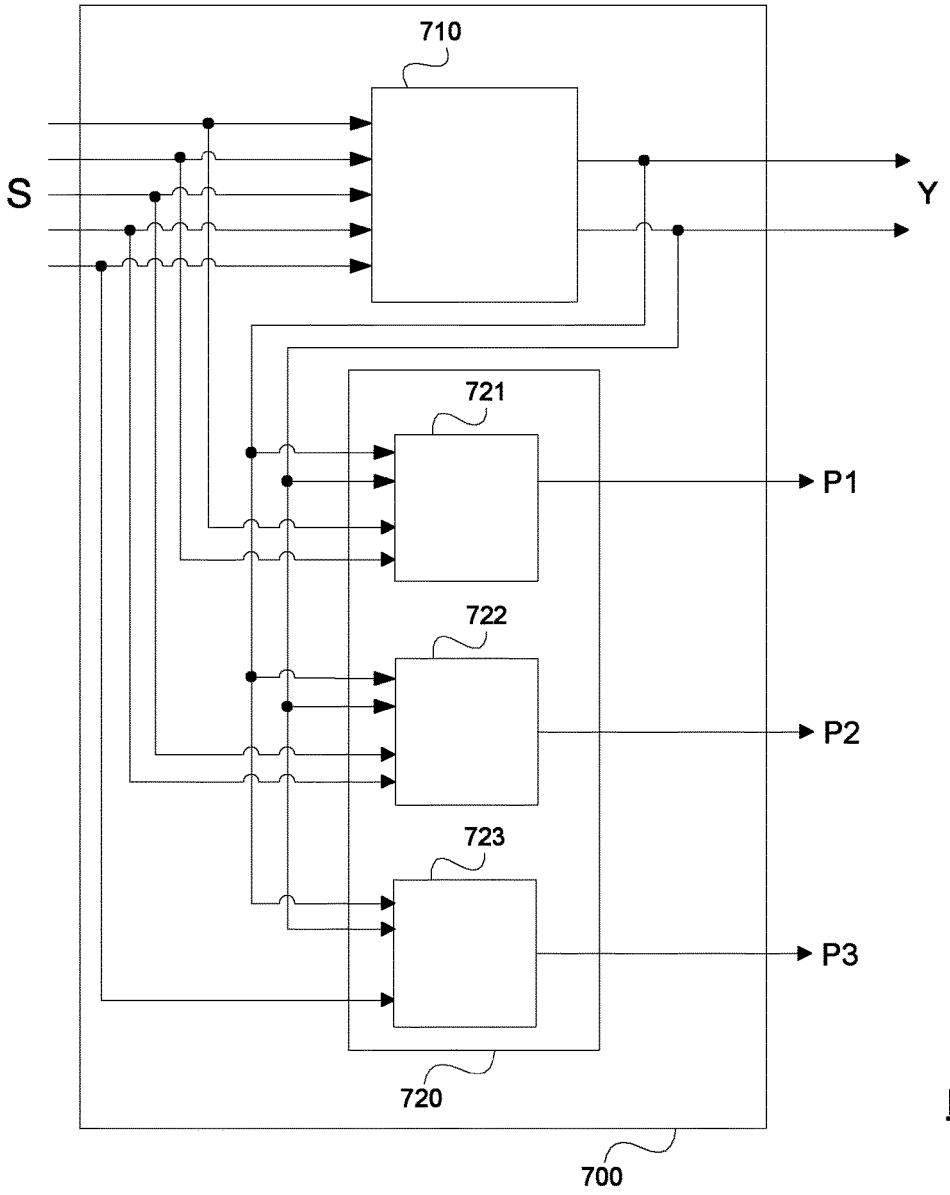
FIG. 7 is a generalized block diagram of an audio encoding system in accordance with an example embodiment.

FIG. 7 is a generalized block diagram of an audio encoding system 700 in accordance with an example embodiment. The audio encoding system 700 comprises a mixing stage 710 adapted to receive a multichannel input signal S and to output, based thereon, a two-channel output signal Y. The audio encoding system 700 further comprises a parameter analyzer 720 adapted to receive the multichannel input signal S and the two-channel output signal Y. The parameter analyzer 720 comprises a first parameter analyzing stage 721 adapted to output, based on the two-channel output signal Y and two channels of the multichannel input signal S, a first set of mixing parameters P1 for controlling a first parametric mixing stage for reconstructing the two channels of the multichannel input signal S from the two-channel output signal Y.

The parameter analyzer 720 may further comprise a second parameter analyzing stage 722 adapted to output, based on the two-channel output signal Y and two channels of the multichannel input signal S (distinct from the two channels received by the first parameter analyzing stage 721), a second set of mixing parameters P2 for controlling a second parametric mixing stage for reconstructing these two channels of the multichannel input signal S from the two-channel output signal Y. The second parameter analyzing stage 722 is then configured to operate independently of the first parameter analyzing stage 721.

Alternatively or additionally to the second parameter analyzing stage 722 described above, the parameter analyzer 720 may comprise a third parameter analyzing stage 723 adapted to output, based on the two-channel output signal Y and one channel of the multichannel input signal S, a third set of mixing parameters P3 for controlling a third parametric mixing stage for reconstructing the one channel of the multichannel input signal S from the two-channel output signal Y. The third parameter analyzing stage 723 is then configured to operate independently of the first parameter analyzing stage 721 (and of the second parametric analyzing stage 722).

It is to be noted that any combination of parameter analyzing stages receiving two channels 721, 722, and parameter analyzing stages receiving one channel 723, may be envisaged, depending on the number of channels available in the multichannel input signal S. For example, the following combinations are envisaged:

- A three-channel input signal S, one parameter analyzing stage receiving two channels and one parameter analyzing stage receiving one channel;
- A four-channel input signal S and two parameter analyzing stages receiving two channels;
- A five-channel input signal S, two parameter analyzing stages receiving two channels and one parameter analyzing stage receiving one channel;
- A six-channel input signal S, and three parameter analyzing stages receiving two channels; and
- A seven-channel input signal, three parameter analyzing stages receiving two channels and one parameter analyzing stage receiving one channel.

The number of mixing parameters in each of the sets of mixing parameters P1, P2, P3 may be at least twice as many as the number of channels from the input audio signal S to be reconstructed using the respective set of mixing parameters.

In particular, the sets of mixing parameters are adapted for controlling two-channel linear combinations to be performed in respective independent parametric mixing stages, preferably operating in parallel, for reconstructing the multichannel input signal S based on the two-channel output signal Y.

For example, the mixing parameters P may be adapted for use in two or more of the parametric mixing stages 110, 320 and 530 in the decoding systems 100, 300, 400, 500, 600 depicted in FIGS. 1, 3, 4, 5 and 6, wherein the output signal Y plays the role of the input signal X. In an example scenario, the multichannel audio signal S may be a five-channel signal comprising a center channel, a left channel, a left surround channel, a right channel and a right surround channel. In the present example scenario, the mixing stage 710 may downmix the five channels into a two-channel output signal Y which is received as the input signal X by the decoding system 500 depicted in FIG. 5. The parameter analyzer 720 may determine mixing parameters P for reconstruction of the five-channel input signal S based on the output signal Y. The mixing parameters P may include a first set P1 of mixing parameters ($\alpha$1, $\beta$1, $\gamma$1, $\gamma$2), determined by the first parameter analyzing stage 721, a second set P2 of mixing parameters ($\alpha$2, $\beta$2, $\gamma$3, $\gamma$4) determined by the second parameter analyzing stage 722 and a third set P3 of mixing parameters ($\alpha$3, $\beta$3, $\gamma$5, $\gamma$6) determined by the third parameter analyzing stage 723, adapted for use in the first, second and third parametric mixing stages 110, 320, 530, respectively, in the decoding system 500 depicted in FIG. 5. As described in relation to FIG. 5, the first set of parameters P1 may be adapted for reconstruction of the left and left surround channels, the second set of parameters P2 may be adapted for reconstruction of the right and right surround channels, and the third set of parameters P3 may be adapted for reconstruction of the center channel.

The values of the sets of parameters may be determined by the respective parameter analyzing stage 721, 722, 723, to enable reconstruction of the respective channels of the multichannel audio signal S. As the parameter analyzing stages 721, 722, 723 operate independently of each other, they may employ different techniques/methods to determine the values of their respective sets of parameters. Moreover, the properties of the parameters, such as quantization formats, frequency band resolution and update frequency (i.e. how often new values can be assigned to the parameters) may be different for the different sets of parameters.

A set of parameters may be determined by the corresponding parameter analyzing stage. For example, the first parameter analyzing stage 721 may receive the two-channel output signal Y as well as the left channel and the left surround channel of the input audio signal S.

In order to determine the values of the first set of mixing parameters P1 for reconstruction of the left and left surround channels from the two-channel output signal Y, the first parameter analyzing stage may reconstruct the left and left surround channels of the multichannel audio signal S from the output signal Y using different test values of the first set of mixing parameters P1. The test reconstructions are then evaluated in order to find which values enable the most faithful reconstruction. For example, energy levels, wave forms and/or cross correlations of the reconstructed channels may be compared to the original left and left surround channels of the multichannel audio signal S in order to determine suitable values of the first set of parameters P1.

In some example embodiments, the parameter analyzer 720 may be further adapted to output an additional mixing parameter based on the multichannel input signal S. This extra parameter may be adapted for use in the additional mixing stage 650 of the decoding system 600 depicted in FIG. 6. The extra parameter may be adapted to control contributions of the additional decorrelated signal D4 (via the additional output signal Y4) to channels of the output signals Y1, Y2, Y3 of the first, second and third parametric mixing stages 110, 320, 530.

In the example scenario described in relation to FIG. 6, the at least one additional parameter is exemplified by the parameter $\delta$. The values of the parameters ($\alpha$1, $\beta$1, $\gamma$1, $\gamma$2), ($\alpha$2, $\beta$2, $\gamma$3, $\gamma$4), ($\alpha$3, $\beta$3, $\gamma$5, $\gamma$6), and $\delta$, used by the decoding system 600 to reconstruct a five-channel signal S, may for example have been determined by the parameter analyzer 720 of the encoding system 700 in FIG. 7.

Values of the parameters may for example be determined according to the following steps. Temporary values of the parameters (($\alpha$1, $\beta$1, $\gamma$1, $\gamma$2), ($\alpha$2, $\beta$2, $\gamma$3, $\gamma$4) and ($\alpha$3, $\beta$3, $\gamma$5, $\gamma$6) may be determined in a first step without any type of energy compensation, and a value of the parameter $\delta$ (controlling the contribution from the additional decorrelated signal D4) may be determined to recover the correct energy in the reconstructed center channel c compared to the center channel in the original five-channel signal S. In a second step, the values of the parameters $\beta$1 and $\beta$2 (controlling the contribution of the first and second decorrelated signals D1 and D2) may be adjusted according to $$\beta 1' = \beta 1\left(\frac{L}{\hat{L}}\right)^{1/2} \text{ and } \beta 2' = \beta 2\left(\frac{R}{\hat{R}}\right)^{1/2},$$

wherein L is the energy in a left downmix channel (l+1s) in the output signal Y and $\hat{L}$ is the energy of an estimated left downmix ($\gamma$1×xl+$\gamma$2×xr). Similarly, R is the energy in a right downmix channel (r+rs) in the output signal Y and $\hat{R}$ is the energy of an estimated right downmix ($\gamma$3×xl+$\gamma$4×xr).

III. Equivalents, Extensions, Alternatives and Miscellaneous

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The systems and methods disclosed hereinabove may be implemented as software, firmware, hardware or a combination thereof In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

What is claimed is:

1. An audio decoding system for processing a two-channel input signal, the audio decoding system comprising a first parametric mixing stage adapted to receive the two-channel input signal and to receive a first set of mixing parameters, the first parametric mixing stage being adapted to output a first two-channel output signal, wherein the first parametric mixing stage comprises:

a first decorrelation stage adapted to output a first decorrelated signal based on the input signal; and a first mixing matrix adapted to receive said input signal and said first decorrelated signal, to form a first two-channel linear combination of channels from said input signal and said first decorrelated signal, and to output said linear combination as said first two-channel output signal, wherein coefficients of said first linear combination are controllable by said first set of mixing parameters, and wherein said first set of mixing parameters comprises at least four mixing parameters, wherein the audio decoding system further comprises a second parametric mixing stage adapted to receive the two-channel input signal and to receive a second set of mixing parameters, independent of the first set of mixing parameters, the second parametric mixing stage being adapted to output a second two-channel output signal, wherein the second parametric mixing stage comprises:

a second decorrelation stage adapted to output a second decorrelated signal based on the input signal; and a second mixing matrix adapted to receive said input signal and said second decorrelated signal, to form a second two-channel linear combination of channels from said input signal and said second decorrelated signal, and to output said second linear combination as said second two-channel output signal, wherein coefficients of said second linear combination are controllable by said second set of mixing parameters, and wherein said second set of mixing parameters comprises at least four mixing parameters, wherein the first and second mixing stages operate in parallel, and are distinguishable from each other by the values of the first and second sets of mixing parameters.

2. The audio decoding system of claim 1, wherein said first decorrelation stage is adapted to output the first decorrelated signal as a one-channel signal.

3. The audio decoding system of claim 1, wherein said first decorrelation stage comprises:

a premixing matrix adapted to form an intermediate linear combination of channels from said input signal, wherein coefficients of said intermediate linear combination are controllable by said first set of mixing parameters only; and a decorrelator adapted to receive the intermediate linear combination and to output, based thereon, said first decorrelated signal.

4. The audio decoding system of claim 1, wherein the first parametric mixing stage is configured to accept said first set of mixing parameters in the form of a set of mixing parameters of which no more than four mixing parameters are independently assignable.

5. The audio decoding system of claim 3, wherein the decorrelator comprises at least one infinite impulse response lattice filter adapted to receive a channel of said intermediate linear combination and to output a channel of said first decorrelated signal.

6. The audio decoding system of claim 3, wherein the decorrelator comprises an artifact attenuator configured to detect sound endings in said intermediate linear combination and to take corrective action in response thereto.

7. The audio decoding system of claim 1, wherein the first mixing matrix is adapted to receive a first side signal comprising spectral data corresponding to frequencies up to a first crossover frequency, the first mixing matrix being operable to form said first two-channel linear combination from said first side signal and channels from said input signal and said first decorrelated signal, and wherein the second mixing matrix is adapted to receive a second side signal comprising spectral data corresponding to frequencies up to a second crossover frequency, the second mixing matrix being operable to form said second two-channel linear combination from said second side signal and channels from said input signal and said second decorrelated signal.

8. The audio decoding system of claim 1, further comprising a third parametric mixing stage adapted to receive the two-channel input signal and to receive a third set of mixing parameters independent of the first and second sets of mixing parameters, the third parametric mixing stage being adapted to output a third output signal, wherein said third parametric mixing stage is adapted to provide at most one channel with independent audio content in the third output signal, wherein the third parametric mixing stage comprises:

a third mixing matrix adapted to receive said input signal, to form a third linear combination of channels from said input signal, and to output said third linear combination as said third output signal, wherein coefficients of said third linear combination are controllable by said third set of mixing parameters, and wherein said third set of mixing parameters comprises at least two mixing parameters.

9. The audio decoding system of claim 1, further comprising a third parametric mixing stage adapted to receive the two-channel input signal and to receive a third set of mixing parameters independent of the first and second sets of mixing parameters, the third parametric mixing stage being adapted to output a third output signal, wherein the third parametric mixing stage comprises:

a third decorrelation stage adapted to output a third decorrelated signal based on the input signal; and a third mixing matrix adapted to receive said input signal and said third decorrelated signal, to form a third two-channel linear combination of channels from said input signal and said third decorrelated signal, and to output said third linear combination as said third two-channel output signal, wherein coefficients of said third linear combination are controllable by said third set of mixing parameters, and wherein said third set of mixing parameters comprises at least four mixing parameters.

10. The audio decoding system of claim 9, wherein the decoding system comprises a controller adapted to receive a collection of mixing parameters, the controller being adapted to provide the first, second and third sets of mixing parameters, being subsets of said collection of parameters, to the first, second and third parametric mixing stages, respectively, and wherein the controller is adapted to control the third mixing stage, via the third set of mixing parameters, to provide at most one channel with independent audio content in the third output signal.

11. The audio decoding system of claim 9, further comprising:

an additional parametric mixing stage adapted to receive the two-channel input signal and an extended set of mixing parameters comprising at least three mixing parameters from said first set of mixing parameters, at least three mixing parameters from said second set of mixing parameters and at least one additional mixing parameter independent of the first, second and third sets of mixing parameters, the additional parametric mixing stage being adapted to output an additional output signal having at least five channels; and a summing stage adapted to add channels of the additional output signal to channels of said first output signal, said second output signal and said third output signal, respectively, wherein said additional parametric stage comprises:

an additional decorrelation stage adapted to output an additional decorrelated signal based on the input signal; and an upmix matrix adapted to generate said additional output signal based on said additional decorrelated signal and said extended set of mixing parameters.

12. The audio decoding system of claim 1, wherein the first parametric mixing stage is adapted:

to receive values of said first set of mixing parameters associated with a plurality of frequency subbands; and to operate on frequency subband representations of the input signal and the first decorrelated signal using values of said first set of mixing parameters associated with the corresponding frequency subbands.

13. The audio decoding system of claim 12, wherein the first parametric mixing stage is adapted to employ a non-uniform frequency subband partition.

14. The audio decoding system of claim 1, wherein at least one mixing parameter of said first set of mixing parameters controls a contribution of said first decorrelated signal to said first linear combination.

15. The audio decoding system of claim 1, wherein two mixing parameters of said first set of mixing parameters are received by the first parametric mixing stage in a first quantized format and control relative contributions of the two input signal channels to an intermediate linear combination, and wherein two different mixing parameters of said first set of mixing parameters are received by the first parametric mixing stage in a second quantized format, distinct from said first quantized format, and control relative contributions of said intermediate linear combination and said first decorrelated signal to said first output signal, wherein said first decorrelated signal is a decorrelated version of said intermediate linear combination.

16. The audio decoding system of claim 1, wherein the first parametric mixing stage is adapted to receive the input signal having a first time resolution in which it is divided into time frames comprising a constant number of samples, and wherein the first parametric mixing stage is operable to receive, during a time frame, one value of each of the first set of mixing parameters, and further operable to receive, during a time frame, two values of each of the first set of mixing parameters.

17. The audio decoding system of claim 16, wherein the first parametric mixing stage is operable to receive the first set of mixing parameters having the first time resolution, and to employ interpolation over time to produce a set of one or more mixing parameters having a second time resolution from said first set of mixing parameters having the first time resolution.

18. The audio decoding system of claim 1, wherein the first and second parametric mixing stages are functionally identical.

19. An audio decoding method for processing a two-channel input signal, the audio decoding method comprising:

receiving the two-channel input signal;

receiving a first set of mixing parameters comprising at least four mixing parameters;

generating a first decorrelated signal based on the input signal;

forming a first two-channel linear combination of channels from said input signal and said first decorrelated signal; and outputting said first linear combination as a two-channel output signal, wherein coefficients of said first linear combination are controllable by said first set of mixing parameters, wherein the method further comprises:

receiving a second set of mixing parameters comprising at least four mixing parameters, wherein the second set of mixing parameters is independent of the first set of mixing parameters;

generating a second decorrelated signal based on the input signal;

forming a second two-channel linear combination of channels from said input signal and said second decorrelated signal; and outputting said second linear combination as a second two-channel output signal, wherein coefficients of said second linear combination are controllable by said second set of mixing parameters, wherein the steps of generating said first and second linear combinations are performed in parallel, and are distinguishable from each other by the values of the first and second sets of mixing parameters.

20. An audio encoding system for processing a multichannel input signal, the audio encoding system comprising:

a mixing stage adapted to receive the multichannel input signal and to output, based thereon, a two-channel output signal; and a parameter analyzer adapted to receive the multichannel input signal and the two-channel output signal, the parameter analyzer comprising:

a first parameter analyzing stage adapted to output, based on said two-channel output signal and a first pair of channels of the multichannel input signal, a first set of mixing parameters for controlling a first parametric mixing stage for reconstructing said first pair of channels of the multichannel input signal from said two-channel output signal, and a second parameter analyzing stage adapted to output, based on said two-channel output signal and a second pair of channels of the multichannel input signal, a second set of mixing parameters for controlling a second parametric mixing stage for reconstructing said second pair of channels of the multichannel input signal from said two-channel output signal, wherein said second parametric analyzing stage is configured to operate independently of said first parametric analyzing stage, wherein the first set of mixing parameters includes at least four mixing parameters, and wherein the second set of mixing parameters includes at least four mixing parameters.

21. The audio encoding system of claim 20, wherein the parameter analyzer is further adapted to output an additional mixing parameter, based on the multichannel input signal, for controlling contributions of an additional decorrelated signal to output channels of the first and second parametric mixing stages.

22. An audio encoding method for processing a multichannel input signal, the audio encoding method comprising:

receiving the multichannel input signal;

outputting, based on the multichannel input signal, a two-channel output signal;

receiving the two-channel output signal;

determining, based on said two-channel output signal and a first pair of channels of the multichannel input signal, a first set of mixing parameters for controlling a first parametric mixing stage for reconstructing said two channels of the multichannel input signal from said two-channel output signal;

determining, based on said two-channel output signal and a second pair of channels of the multichannel input signal, and independently of the step of determining a first set of mixing parameters, a second set of mixing parameters for controlling a second parametric mixing stage for reconstructing said second pair of channels of the multichannel input signal from said two-channel output signal; and outputting said first and second sets of mixing parameters, wherein the first set of mixing parameters includes at least four mixing parameters and wherein the second set of mixing parameters includes at least four mixing parameters.

23. A computer program product comprising a computer-readable medium with instructions for performing the method of claim 19.

* * * * *